US011353263B2

(12) United States Patent
Plavnik

(10) Patent No.: US 11,353,263 B2
(45) Date of Patent: Jun. 7, 2022

(54) ULTRASONIC DRYING SYSTEM AND METHOD

(71) Applicant: Heat Technologies, Inc., Atlanta, GA (US)

(72) Inventor: Zinovy Plavnik, Atlanta, GA (US)

(73) Assignee: Heat Technologies, Inc., Atlanta, GA (US)

( * ) Notice: Subject to any disclaimer, the term of this patent is extended or adjusted under 35 U.S.C. 154(b) by 49 days.

(21) Appl. No.: 16/990,428

(22) Filed: Aug. 11, 2020

(65) Prior Publication Data

US 2020/0370827 A1 Nov. 26, 2020

Related U.S. Application Data

(63) Continuation of application No. 16/017,459, filed on Jun. 25, 2018, now Pat. No. 10,775,104, which is a continuation of application No. 14/698,104, filed on Apr. 28, 2015, now Pat. No. 10,006,704, which is a continuation of application No. 12/367,803, filed on Feb. 9, 2009, now Pat. No. 9,068,775.

(51) Int. Cl.

| | |
|---|---|
| ***F26B 7/00*** | (2006.01) |
| ***F26B 5/02*** | (2006.01) |
| ***F26B 3/28*** | (2006.01) |
| ***F26B 21/00*** | (2006.01) |
| ***B41F 23/04*** | (2006.01) |

(52) U.S. Cl.

CPC ..... *F26B 5/02* (2013.01); *B41F 23/0466* (2013.01); *F26B 3/283* (2013.01); *F26B 7/00* (2013.01); *F26B 21/004* (2013.01)

(58) Field of Classification Search

CPC .... F26B 5/02; F26B 3/283; F26B 7/00; F26B 21/004; F26B 3/36; B41F 23/0466

USPC ..... 34/426, 401, 397

See application file for complete search history.

(56) References Cited

U.S. PATENT DOCUMENTS

| | | | |
|---|---|---|---|
| 2,470,202 | A | 4/1956 | Fowle |
| 2,972,196 | A | 2/1961 | Early et al. |
| 3,186,329 | A | 6/1965 | Kennedy |

(Continued)

FOREIGN PATENT DOCUMENTS

| | | |
|---|---|---|
| AU | 2015284664 | 11/2019 |
| CA | 2748263 | 11/2014 |

(Continued)

OTHER PUBLICATIONS

Plavnik, Zinovy Zalman; Office Action for Canadian patent application No. 2,951,068, filed Jun. 5, 2015, dated May 31, 2021, 3 pgs.

(Continued)

*Primary Examiner* — John P McCormack

(74) *Attorney, Agent, or Firm* — Taylor English Duma LLP

(57) ABSTRACT

A drying apparatus can include, in some aspects, an ultrasonic transducer and an infrared heater positioned proximate to the ultrasonic transducer and configured to emit infrared light. The drying apparatus can include a plurality of ultrasonic transducers. The drying apparatus can include a delivery enclosure defining a bottom wall, the bottom wall defining a plurality of air outlets; the ultrasonic transducer mounted to the delivery enclosure; and the drying apparatus can include an air mover mounted to the delivery enclosure.

20 Claims, 26 Drawing Sheets

(56) References Cited

U.S. PATENT DOCUMENTS

| | | | | |
|---|---|---|---|---|
| 3,346,932 | A | 10/1967 | Cheape, Jr. | |
| 3,557,466 | A | 1/1971 | Bodine | |
| 3,668,785 | A | 6/1972 | Rodwin | |
| 3,694,926 | A | 10/1972 | Rodwin et al. | |
| 3,750,306 | A | 8/1973 | Rodwin et al. | |
| 3,864,249 | A | 2/1975 | Wallis | |
| 4,178,188 | A | 12/1979 | Dussault et al. | |
| 4,302,623 | A | 11/1981 | Canfield | |
| 4,501,072 | A * | 2/1985 | Jacobi, Jr. | F26B 3/283 101/488 |
| 4,561,953 | A | 12/1985 | Muralidhara et al. | |
| 4,689,895 | A | 9/1987 | Taylor et al. | |
| 4,729,175 | A | 3/1988 | Beard et al. | |
| 4,763,424 | A | 8/1988 | Taylor et al. | |
| 4,771,205 | A | 9/1988 | Mequio | |
| 4,876,803 | A | 10/1989 | Wedel | |
| 5,105,557 | A | 4/1992 | Vadasz | |
| 5,220,346 | A | 6/1993 | Carreira et al. | |
| 5,396,270 | A | 3/1995 | Gooray et al. | |
| 5,595,349 | A | 1/1997 | Bergstorm et al. | |
| 5,617,887 | A | 4/1997 | Shibano | |
| 5,630,420 | A | 5/1997 | Vaitekunas | |
| 5,631,685 | A | 5/1997 | Gooray et al. | |
| 6,049,995 | A * | 4/2000 | Rogne | F26B 3/283 34/269 |
| 6,085,437 | A * | 7/2000 | Stipp | D21F 5/006 34/115 |
| 6,090,241 | A | 7/2000 | Trokhan et al. | |
| 6,176,184 | B1 | 1/2001 | Mudry | |
| 6,203,151 | B1 | 3/2001 | Ruhe | |
| 6,210,149 | B1 | 4/2001 | Plavnik | |
| 6,233,844 | B1 | 5/2001 | Gallego Juarez et al. | |
| 6,308,436 | B1 | 10/2001 | Stipp | |
| 6,376,145 | B1 | 4/2002 | Meyer | |
| 6,393,719 | B1 | 5/2002 | Stipp | |
| 6,431,702 | B2 | 8/2002 | Ruhe | |
| 6,503,580 | B1 | 1/2003 | Ruffa | |
| 6,537,600 | B1 * | 3/2003 | Meldrum | A23B 7/015 426/102 |
| 6,662,812 | B1 * | 12/2003 | Hertz | B08B 7/028 134/1.3 |
| 6,742,285 | B2 | 6/2004 | Shepard | |
| 6,754,980 | B2 | 6/2004 | Lauerhaas | |
| 6,931,205 | B2 | 8/2005 | Atkins | |
| 7,293,567 | B2 | 11/2007 | Hertz et al. | |
| 7,497,301 | B2 | 3/2009 | Cheng et al. | |
| 8,105,526 | B2 | 1/2012 | Stone et al. | |
| 8,756,825 | B2 | 6/2014 | Priebe | |
| 8,943,706 | B2 | 2/2015 | Bucks | |
| 9,068,775 | B2 | 6/2015 | Plavnik | |
| 9,140,494 | B2 | 9/2015 | Bucks et al. | |
| 9,163,875 | B2 | 10/2015 | Bucks | |
| 9,671,166 | B2 | 6/2017 | Plavnik et al. | |
| 9,851,146 | B2 | 12/2017 | Huber et al. | |
| 10,006,704 | B2 | 6/2018 | Plavnik | |
| 10,139,162 | B2 | 11/2018 | Plavnik et al. | |
| 10,488,108 | B2 | 11/2019 | Plavnik et al. | |
| 10,775,104 | B2 | 9/2020 | Plavnik | |
| 2003/0184630 | A1 | 10/2003 | Elgee | |
| 2004/0011133 | A1 | 1/2004 | Busch et al. | |
| 2004/0124230 | A1 | 7/2004 | Hertz et al. | |
| 2005/0211387 | A1 | 9/2005 | Suzuki et al. | |
| 2007/0128368 | A1 | 6/2007 | Minamino et al. | |
| 2007/0169371 | A1 | 7/2007 | Feng et al. | |
| 2007/0169800 | A1 | 7/2007 | Fani et al. | |
| 2008/0301971 | A1 | 12/2008 | Koretsky | |
| 2009/0007931 | A1 | 1/2009 | Krebs et al. | |
| 2009/0300939 | A1 | 12/2009 | Kennedy et al. | |
| 2010/0019951 | A1 | 1/2010 | Jordan | |
| 2010/0071194 | A1 | 3/2010 | Derrick et al. | |
| 2010/0199510 | A1 | 8/2010 | Plavnik | |
| 2011/0131829 | A1 | 6/2011 | Zagar et al. | |
| 2014/0015028 | A1 | 1/2014 | Park et al. | |
| 2014/0150285 | A1 | 6/2014 | Bucks et al. | |
| 2014/0152749 | A1 | 6/2014 | Shifley | |
| 2014/0202021 | A1 | 7/2014 | Bucks | |
| 2014/0202024 | A1 | 7/2014 | Bucks et al. | |
| 2015/0233637 | A1 | 8/2015 | Plavnik | |
| 2015/0239021 | A1 | 8/2015 | Ponomarev | |
| 2016/0003541 | A1 | 1/2016 | Plavnik | |
| 2016/0025411 | A1 | 1/2016 | Plavnik | |
| 2017/0219284 | A1 | 8/2017 | Plavnik | |
| 2018/0363980 | A1 | 12/2018 | Plavnik | |

FOREIGN PATENT DOCUMENTS

| | | |
|---|---|---|
| DE | 1031264 | 6/1958 |
| DE | 2053284 | 5/1971 |
| EP | 2394121 | 3/2019 |
| EP | 3543633 | 2/2021 |
| EP | 3164655 | 3/2021 |
| EP | 3172515 | 7/2021 |
| JP | H05133683 | 5/1993 |
| JP | 06026764 | 2/1994 |
| JP | H0626764 | 2/1994 |
| JP | H0755339 | 3/1995 |
| JP | 2000258055 | 9/2000 |
| JP | 2004066042 | 3/2004 |
| JP | 2005292291 | 10/2005 |
| JP | 2012229841 | 11/2012 |
| KR | 101273231 | 6/2013 |
| SU | 614303 | 7/1978 |
| WO | 9805580 | 2/1998 |
| WO | 0001883 | 1/2000 |
| WO | 0019007 | 4/2000 |
| WO | 0196115 | 12/2001 |
| WO | 2006042559 | 4/2006 |
| WO | 2007066524 | 6/2007 |
| WO | 2009057054 | 5/2009 |
| WO | 2010090690 | 12/2010 |
| WO | 2016160320 | 11/2012 |
| WO | 2013182654 | 12/2013 |
| WO | 2014048431 | 4/2014 |
| WO | 2014113318 | 7/2014 |
| WO | 2016014960 | 1/2016 |

OTHER PUBLICATIONS

Web Systems Inc.; Ultra Web Cleaner1 internet article-www.wsinfo.com/index.html; Printed Dec. 7, 2008; 6 pgs.

Kelva; Web Cleaner—Web cleaner head BR41/Filter and fan unit K-22; internet article—www.kelva.com; document available prior to Feb. 9, 2008; Lund, Sweden; 4 pgs.

Bosch Packaging North America; Article entitled: "Top 10 packaging materials (films) used on horizontal flow wrappers", Jun. 28, 2013, 5 pgs.

Morin, David; "Chapter 7—2D Waves and other topics", available at http://www.people.fas.harvard.edu/~djmorin/book.html, publicly available prior to Jul. 1, 2013,11 pgs.

Kohler, Herbert B.; "Modern Rod Coaters", available at www.kohlercoating.com/reference/refpdfs/HBKrodcoater. PDF, publicly available prior to Feb. 9, 2008, 7 pgs.

Incropera, et al.; "The Effects of Turbulence", Fundamentals of Heat and Mass Transfer, 1996, 7 pgs.

Wikipedia, Article entitled "Coating", located at http://en.wikipedia.org/wiki/Coating, accessed on Apr. 25, 2014, 5 pgs.

Wikipedia; Article entitled "Mersenne's Law", located at http://en.wikipedia.org/wiki/Mersenne%27s_Laws, accessed on May 2, 2014, 2 pgs.

Plavnik, Zinovy; Office Action for European application No. 09839835.7, filed Dec. 23, 2009, dated Jun. 19, 2018, 4 pgs.

Plavnik, Zinovy Zalman; Extended European Search Report for serial No. 19163899.8, filed Dec. 23, 2009, dated Mar. 23, 2019, 8 pgs.

Plavnik, Zinovy Zalman: International Preliminary Report on Patentability for PCT/US15/034440, filed Jun. 5, 2015, dated Jan. 12, 2017, 8 pgs.

Plavnik, Zinovy; International Search Report and Written Opinion for PCT Application No. PCT/US15/34440, filed Jun. 5, 2015, dated Sep. 14, 2015, 9 pgs.

(56) References Cited

OTHER PUBLICATIONS

Plavnik, Zinovy Zalman; European Search Report for serial No. 15815936.8, filed Jun. 5, 2015, dated Mar. 10, 2020, 7 pgs.
Plavnik, Zinovy Zalman; European Search Report for serial No. 15815936.8, filed Jun. 5, 2015, dated Aug. 26, 2019, 5 pgs.
Plavnik, Zinovy Zalman; European Search Report for serial No. 15815936.8, filed Jun. 5, 2015, dated Apr. 9, 2019, 5 pgs.
Plavnik, Zinovy Zalman; European Search Report for serial No. 15815936.8, filed Jun. 5, 2015, dated Oct. 18, 2018, 7 pgs.
Plavnik, Zinovy Zalman; Extended European Search Report for serial No. 15815936.8, filed Jun. 5, 2015, dated Jan. 2, 2018, 9 pgs.
Plavnik, Zinovy Zalman; Office Action for Japanese application No. 521055/2017, filed Jun. 5, 215, dated Aug. 28, 2020, 19 pgs.
Plavnik, Zinovy Zalman; Office Action for Japanese application No. 521055/2017, filed Jun. 5, 215, dated Aug. 6, 2019, 9 pgs.
Plavnik, Zinovy Zalman; Office Action for Japanese application No. 521055/2017, filed Jun. 5, 215, dated Oct. 2, 2018, 9 pgs.
Plavnik, Zinovy Zalman; Examination Report for Australian application No. 2015284664, filed Jun. 5, 2015, dated Mar. 22, 2019, 3 pgs.
Plavnik, Zinovy Zalman; Office Action for Brazil patent application No. BR112016029586-2, filed Jun. 5, 2015, dated May 26, 2020, 5 pgs.
Plavnik, Zinovy; International Preliminary Report on Patentability for Serial No. PCT/US15/42028, filed Jul. 24, 2015, dated Feb. 2, 2017, 7 gs.
Plavnik, Zinovy; International Search Report and Written Opinion for serial No. PCT/US15/42028, filed Jul. 24, 2015, dated Oct. 23, 2015, 8 pgs.
Plavnik, Zinovy Zalman; Examination Report for European serial No. 15824606.6, filed Jul. 24, 2015, dated Aug. 19, 2020, 6 pgs.
Plavnik, Zinovy Zalman; Examination Report for European serial No. 15824606.6, filed Jul. 24, 2015, dated Jan. 21, 2019, 5 pgs.
Plavnik, Zinovy Zalman; Extended European Search Report for serial No. 15824606.6, filed Jul. 24, 2015, dated Jan. 16, 2018, 8 pgs.
Plavnik, Zinovy; U.S. Provisional Patent Application entitled: Acoustic-Assisted Heat and Masds Transfer Device, U.S. Appl. No. 62/028,656, filed Jul. 24, 2014; 21 pgs.
"PCB Basics" by SFUPTOWNMAKER.. Jan. 12, 2013. Sparkfun. [retrieved from the internet] [retrieved on Aug. 15, 2015]. <URL:https://leam.sparkfun.com/tutorials/pcb-basics> ; p. 4, figure 1, paragraph 1 and 2, 13.
Plavnik, Zinovy; Advisory Action for U.S. Appl. No. 12/367,803, filed Feb. 9, 2009, dated Nov. 20, 2012, 6 pgs.
Plavnik, Zinovy; Applicant Initiated Interview Summary for U.S. Appl. No. 12/367,803, filed Feb. 9, 2009, dated Jan. 28, 2014, 3 pgs.
Plavnik, Zinovy; Applicant Initiated Interview Summary for U.S. Appl. No. 12/367,803, filed Feb. 9, 2009, dated Jul. 2, 2014, 3 pgs.
Plavnik, Zinovy; Final Office Action for U.S. Appl. No. 12/367,803, filed Feb. 9, 2009, dated Dec. 2, 2013, 12 pgs.
Plavnik, Zinovy; Final Office Action for U.S. Appl. No. 12/367,803, filed Feb. 9, 2009, dated Jul. 30, 2012, 21 pgs.
Plavnik, Zinovy; Final Office Action for U.S. Appl. No. 12/367,803, filed Feb. 9, 2009, dated Nov. 18, 2014, 21 pgs.
Plavnik, Zinovy; Issue Notification for U.S. Appl. No. 12/367,803, filed Feb. 9, 2009, dated Jun. 10, 2015, 1 pg.
Plavnik, Zinovy; Non-Final Office Action for U.S. Appl. No. 12/367,803, filed Feb. 9, 2009, dated Jan. 31, 2012, 21 pgs.
Plavnik, Zinovy; Non-Final Office Action for U.S. Appl. No. 12/367,803, filed Feb. 9, 2009, dated May 1, 2014, 22 pgs.
Plavnik, Zinovy; Non-Final Office Action for U.S. Appl. No. 12/367,803, filed Feb. 9, 2009, dated Apr. 8, 2013, 20 pgs.
Plavnik, Zinovy; Notice of Allowance for U.S. Appl. No. 12/367,803, filed Feb. 9, 2009, dated Feb. 5, 2015, 11 pgs.
Plavnik, Zinovy; Notice of Allowance for U.S. Appl. No. 12/367,803, filed Feb. 9, 2009, dated May 18, 2015, 13 pgs.
Plavnik, Zinovy; Restriction Requirement for U.S. Appl. No. 12/367,803, filed Feb. 9, 2009, dated Oct. 24, 2011, 7 pgs.
Plavnik, Zinovy Zalman; Non-Final Office Action for U.S. Appl. No. 14/698,104, filed Apr. 28, 2015, dated May 24, 2017, 48 pgs.
Plavnik, Zinovy; Applicant Initiated Interview Summary for U.S. Appl. No. 14/698,104, filed Apr. 28, 2017, dated Aug. 24, 2017, 3 pages.
Plavnik, Zinovy; Corrected Notice of Allowance for U.S. Appl. No. 14/698,104, filed Apr. 28, 2015, dated Feb. 27, 2018, 6 pgs.
Plavnik, Zinovy; Notice of Allowance for U.S. Appl. No. 14/698,104; filed Apr. 28, 2015, dated Nov. 30, 2017, 17 pgs.
Zinovy, Plavnik; Issue Notification for U.S. Appl. No. 14/698,104, filed Apr. 28, 2015, dated Jun. 6, 2018, 1 pg.
Plavnik, Zinovy; Applicant-Initiated Interview Summary for U.S. Appl. No. 16/017,459, filed Jun. 25, 2018, dated Apr. 27, 2020, 10 pgs.
Plavnik, Zinovy; Non-Final Office Action for U.S. Appl. No. 16/017,459, filed Jun. 25, 2018, dated Feb. 12, 2020, 58 pgs.
Plavnik, Zinovy; Notice of Allowance for U.S. Appl. No. 16/017,459, filed Jun. 25, 2018, dated May 12, 2020, 5 pgs.
Plavnik, Zinovy; Supplemental Notice of Allowance for U.S. Appl. No. 16/017,459, filed Jun. 25, 2018, dated Jun. 8, 2020, 6 pgs.
Article entitled: "drying "; Academic Press Dictionary of Science and Technology, edited by Christopher G. Morris. 4th ed. Elsevier Science & Technology, 1992.http://search.credoreference.com/content/entry/apdst/drying/O. Accessed May 2017.
Plavnik, Zinovy Zalman; Advisory Action for U.S. Appl. No. 14/321,354, filed Jul. 1, 2014, dated Nov. 19, 2018, 5 pgs.
Plavnik, Zinovy Zalman; Applicant Interview Summary for U.S. Appl. No. 14/321,354, filed Jul. 1, 2014, dated Jan. 16, 2018, 3 pgs.
Plavnik, Zinovy Zalman; Applicant-Initiated Interview Summary for U.S. Patent Applicant No. U.S. Appl. No. 14/321,354, filed Jul. 1, 2014, dated Feb. 19, 2019, 9 pgs.
Plavnik, Zinovy Zalman; Corrected Notice of Allowance for U.S. Appl. No. 14/321,354, filed Jul. 1, 2014, dated Oct. 16, 2019, 10 pgs.
Plavnik, Zinovy Zalman; Final Office Action for U.S. Appl. No. 14/321,354, filed Jul. 1, 2014, dated May 31, 2017, 27 pgs.
Plavnik, Zinovy Zalman; Final Office Action for U.S. Appl. No. 14/321,354, filed Jul. 1, 2014, dated Jun. 15, 2018, 32 pgs.
Plavnik, Zinovy Zalman; Non-Final Office Action for U.S. Appl. No. 14/321,354, filed Jul. 1, 2014, dated Jan. 17, 2019, 40 pgs.
Plavnik, Zinovy Zalman; Non-Final Office Action for U.S. Appl. No. 14/321,354, filed Jul. 1, 2014, dated Oct. 17, 2017, 23 pgs.
Plavnik, Zinovy Zalman; Non-Final Office Action for U.S. Appl. No. 14/321,354, filed Jul. 1, 2014, dated Nov. 16, 2016, 48 pgs.
Plavnik, Zinovy Zalman; Notice of Allowance for U.S. Appl. No. 14/321,354, filed Jul. 1, 2014, dated Jul. 29, 2019, 30 pgs.
Plavnik, Zinovy; Applicant Initiated Interview Summary for U.S. Appl. No. 14/321,354, filed Jul. 1, 2014, dated Dec. 28, 2016, 3 pgs.
Busnaina, et al.; Article entitled: "Ultrasonic and Megasonic Particle Removal", Precision Cleaning '95 Proceedings, cited in the Non-Final Office Action for U.S. Appl. No. 14/808,625 dated Sep. 22, 2016, 14 pgs.
Plavnik, Zinovy Zalman; Applicant Interview Summary for U.S. Appl. No. 14/808,625, filed Jul. 24, 2015, dated Nov. 10, 2016, 3 pgs.
Plavnik, Zinovy Zalman; Non-Final Office Action for U.S. Appl. No. 14/808,625, filed Jul. 24, 2015, dated Sep. 22, 2016, 18 pgs.
Plavnik, Zinovy; Issue Notification for U.S. Appl. No. 14/808,625, filed Jul. 24, 2015, dated May 17, 2017, 1 page.
Plavnik, Zinovy; Notice of Allowance for U.S. Appl. No. 14/808,625, filed Jul. 24, 2015, dated Jan. 13, 2017, 7 pgs.
Plavnik, Zinovy Zalman; Applicant-Initiated Interview Summary for U.S. Appl. No. 15/486,469, filed Apr. 13, 2017, dated May 17, 2018, 5 pgs.
Plavnik, Zinovy Zalman; Issue Notification for U.S. Appl. No. 15/486,469, filed Apr. 13, 2017, dated Nov. 7, 2018, 1 pg.
Plavnik, Zinovy Zalman; Non-Final Office Action for U.S. Appl. No. 15/486,469, filed Apr. 13, 2017, dated Feb. 26, 2018, 25 pgs.
Plavnik, Zinovy Zalman; Notice of Allowance for U.S. Appl. No. 15/486,469, filed Apr. 13, 2017, dated Jul. 13, 2018, 5 pgs.
Plavnik, Zinovy Zalman; Supplemental Notice of Allowance for U.S. Appl. No. 15/486,469, filed Apr. 13, 2017, dated Oct. 23, 2018, 4 pgs.

(56) References Cited

OTHER PUBLICATIONS

Plavnik, Zinovy Zalman; Supplemental Notice of Allowance for U.S. Appl. No. 15/486,469, filed Apr. 13, 2017, dated Sep. 6, 2018, 6 pgs.
Plavnik, Zinovy; International Preliminary Report on Patentability for PCT/US2009/069395, filed Dec. 23, 2009, dated Aug. 9, 2011, 12 pgs.
Plavnik, Zinovy; International Search Report and Written Opinion for PCT/US2009/069395, filed Dec. 23, 2009, dated Mar. 23, 2010, 13 pgs.
Plavnik, Zinovy; Canadian Office Action for serial No. 2,748,263, filed Dec. 23, 2009, dated Apr. 16, 2013, 4 pgs.
Plavnik, Zinovy; Extended European Search Report for serial No. 09839835.7, filed Dec. 23, 2009, dated Oct. 26, 2016, 14 pgs.
Plavnik, Zinovy Zalman; Notice of Intention to Grant for European serial No. 15824606.6, filed Jul. 24, 2015, dated Feb. 16, 2021, 79 pgs.
Plavnik, Zinovy Zalman; Office Action for Canadian patent application No. 2,951,068, filed Jun. 5, 2015, dated Nov. 24, 2021, 3 pgs.

* cited by examiner

ULTRASONIC DRYING SYSTEM AND METHOD

REFERENCE TO RELATED APPLICATIONS

This application is a continuation of U.S. application Ser. No. 16/017,459, filed Jun. 25, 2018, which is a continuation of U.S. application Ser. No. 14/698,104, filed Apr. 28, 2015, which issued into U.S. Pat. No. 10,006,704 on Jun. 26, 2018, which is a continuation of U.S. application Ser. No. 12/367,803, filed Feb. 9, 2009, which issued into U.S. Pat. No. 9,068,775 on Jun. 30, 2015, each of which is hereby specifically incorporated by reference herein in its entirety.

TECHNICAL FIELD

The present invention relates generally to heating and drying technologies and, in particular, to heating and drying assisted with ultrasound.

BACKGROUND

It is well known that the majority of energy intensive processes are driven by the rates of the heat and mass transfer. Specific details of a particular application, such as the chemistry of a substrate to be dried (e.g., a factor in label printing, sheet-fed and continuous printing, converting, packaging, mass mailing), the temperature of a material being applied, the needed residence time for a coating to dry, and water or solvent evaporation rates, are necessary for a drying and heating process to work properly. These factors dictate the size of the drying equipment.

It is also well known that the main thing that prevents an increase in heating and drying rates is the boundary layer that is formed around the subject or material to be heated or dried. In modern heating and drying practice there are several methods to disrupt the boundary layer. The most common method is to add hot convection air to other heating methods, such as, for example, radiant heating.

With convective heat, high-velocity impinging jets of hot air are directed onto the material and, consequently, onto the boundary layer to agitate the boundary layer. Similarly, impinging hot-air jets are used in infrared-light heating. Applying a convective airflow or infrared light typically increases the heat transfer rate by about 10-25%. Thus, these approaches have provided some improvement in heat-transfer rates, but further improvements are needed.

There are also known efforts of using pulse combustion to establish pulsating heat jets and apply them onto a material in order to reduce the boundary layer. With pulse combustion jets, flame generates sound in the audible frequency range. The use of pulse combustion jets typically increases the heat transfer rate by about 200-500% (when making a comparison with the same steady-state velocities, Reynolds numbers, and temperatures). Thus, this approach has provided significant improvement in heat-transfer rates, but the pulse combustion equipment is large/space-consuming and costly to purchase and operate. Additionally, a variety of industries require more compact equipment, and combustion gases sometimes are not allowed in the process due to its chemical nature (food, paints, coatings, printing, concerns of explosives, building codes, needs for additional natural gas lines, its maintenance, etc.).

Accordingly, it can be seen that a need exists for improved drying technologies that produce significantly increased heat-transfer rates but that are cost-efficient to make and use and preferably have a smaller footprint and require less material. It is to the provision of solutions meeting this and other needs that the present invention is primarily directed.

SUMMARY

Generally described, the present invention provides a drying apparatus including a delivery air enclosure, through which forced air is directed toward the material, and at least one ultrasonic transducer. The ultrasonic transducer is arranged and operated to generate acoustic oscillations that effectively break down the boundary layer to increase the heat transfer rate. In particular, the acoustic outlet of the ultrasonic transducer is positioned a spaced distance from the material such that the acoustic oscillations are in the range of about 120 dB to about 190 dB at the interface surface of the material. Preferably, the acoustic oscillations are in the range of about 160 dB to about 185 dB at the interface surface of the material.

In one aspect, disclosed is a drying apparatus comprising: a delivery enclosure defining a bottom wall, the bottom wall defining a plurality of air outlets; an ultrasonic transducer mounted to the delivery enclosure; an air mover mounted to the delivery enclosure; and an infrared heater configured to emit infrared light.

In another aspect, disclosed is a drying apparatus comprising: a plurality of ultrasonic transducers; and an infrared heater positioned proximate to the plurality of ultrasonic transducers and configured to emit infrared light.

In another aspect, disclosed is a drying apparatus comprising: a delivery enclosure defining a plurality of air outlets; an ultrasonic transducer mounted to the delivery enclosure; and a heater configured to produce radiant heat, the heater comprising an inner heater element and an outer heater element, each of the inner heater element and the outer heater element defining thermal conductive plates.

In another aspect of the invention, the ultrasonic transducers are positioned a spaced distance from the material to be dried of about $(\lambda)(n/4)$, where $\lambda$, is the wavelength of the ultrasonic oscillations and "n" is plus or minus 0.5 of an odd integer (0.5 to 1.5, 2.5 to 3.5, 4.5 to 5.5, etc.). Preferably, the ultrasonic transducers are positioned relative to the material to be dried the spaced distance of about $(\lambda)(n/4)$, where "n" is an odd integer (1, 3, 5, 7, etc.). In this way, the amplitude of the acoustic oscillations is at about maximum at the interface surface of the material to more effectively agitate the boundary layer.

In a first example embodiment of the invention, the apparatus includes a return air enclosure for drawing moist air away from the material, with the delivery enclosure positioned within the delivery enclosure so that the warm moist return air in the return enclosure helps reduce heat loss by the air in the delivery enclosure. The ultrasonic transducer is of a pneumatic type that is positioned within an air outlet of the delivery enclosure so that all or at least a portion of the forced air is directed through the pneumatic ultrasonic transducer.

In a second example embodiment of the invention, the apparatus is included in a printing system that additionally includes other components known to those skilled in the art. In this embodiment, the apparatus includes two delivery enclosures, one return enclosure, and two ultrasonic transducers. In addition to the apparatus, the printing system includes an air-mover (e.g., a fan, blower, or compressor) and a heater that cooperate to deliver heated steady-state air to the apparatus.

In a third example embodiment of the invention, the apparatus is included in a printing system that additionally includes other components known to those skilled in the art. In this embodiment, the apparatus includes five delivery enclosures each having at least one ultrasonic transducer. In addition to the apparatus, the printing system includes an air-mover and control valving that can be controlled to operate all or only selected ones of the ultrasonic transducer for localizing the drying, depending on the particular job at hand.

In fourth and fifth example embodiments of the invention, the apparatus each include a return enclosure with a plurality of return air inlets and three delivery enclosures within the return enclosure. In these embodiments, one delivery enclosure is dedicated for delivering steady-state air and the other two have ultrasonic transducers for delivering the acoustic oscillations to the material. In the fourth example embodiment, the two acoustic delivery enclosures are positioned immediately before and after (relative to the moving material) the dedicated air delivery enclosure. And in the fifth example embodiment, the two acoustic delivery enclosures are positioned at the front and rear ends (relative to the moving material) of the return enclosure, that is, at the very beginning and end of the drying zone.

In a sixth example embodiment of the invention, the apparatus includes a return enclosure, a delivery enclosure, and an ultrasonic transducer. However, the delivery enclosure is not positioned within the return enclosure; instead, these enclosures are arranged in a side-by-side configuration. In addition, an electric heater is mounted to the delivery enclosure for applying heat directly to the material.

In a seventh example embodiment of the invention, the apparatus includes a delivery enclosure, an ultrasonic transducer, and a heater. The heater may be bi-directional for heating the air inside the delivery enclosure (convective heat) and directly heating the material (radiant heat).

In eighth, ninth, and tenth example embodiments of the invention, the apparatus include a delivery enclosure with a plurality of air outlets and a plurality of electric ultrasonic transducers. In the eighth example embodiment, the air outlets and electric ultrasonic transducers are positioned in an alternating, repeating arrangement. The ninth example embodiment includes an electric heater within the delivery enclosure. And the tenth example embodiment includes waveguides housing the ultrasonic transducers for focusing/enhancing and directing the acoustic oscillations toward the material.

In an eleventh example embodiment of the invention, the apparatus includes a delivery enclosure with a plurality of air outlets and a plurality of electric ultrasonic transducers. In addition, the apparatus includes infrared-light-emitting heaters.

In a twelfth example embodiment of the invention, the apparatus is a stand-alone device including a delivery enclosure with a plurality of air outlets and housing a plurality of electric ultrasonic transducers, a plurality of infrared-light-emitting heaters, and an air mover.

In a thirteenth example embodiment of the invention, the apparatus includes a delivery enclosure with a plurality of air outlets, a plurality of electric ultrasonic transducers, and a plurality of infrared-light-emitting heaters. In this embodiment, steady-state air is not forced by an air mover through the delivery enclosure, but instead the infrared heater by itself generates the heat and the airflow.

In a fourteenth example embodiment of the invention, the apparatus includes a plurality of ultrasonic transducers mounted on a panel, with no steady-state air forced by an air mover through an enclosure. Instead, the apparatus includes at least one ultraviolet (UV) heater for generating the heat and the airflow.

In fifteenth and sixteenth example embodiments of the invention, the apparatus each include a delivery enclosure with an air outlet for delivering forced air to the material, and at least one ultrasonic transducer for delivering acoustic oscillations to the material. The ultrasonic transducers are mounted within the delivery enclosure to set up a field of acoustic oscillations through which the forced air passes before reaching the material to be dried, and they are not oriented to direct the acoustic oscillations toward the air outlet. In the fifteenth example embodiment, three rows of ultrasonic transducers are mounted to an inner wall of the delivery enclosure to set up a field of acoustic oscillations throughout the delivery enclosure. And in the sixteenth example embodiment, the ultrasonic transducer is mounted immediately adjacent the air outlet. In addition, wing elements can be mounted to the electric ultrasonic transducers to enhance the acoustic oscillations for more effective disruption of the boundary layer.

In addition, the present invention provides a method of calibrating drying apparatus such as those described above. The method includes the steps of calculating the spaced distance using the formula $(\lambda)(n/4)$; positioning the ultrasonic transducer outlet and the material at the spaced distance from each other; positioning a sound input device immediately adjacent the interface surface of the material; connecting the sound input device to a signal conditioner; measuring the pressure of the acoustic oscillations at the interface surface of the material using the sound input device and the signal conditioner; converting the measured pressure to decibels; and repositioning the ultrasonic transducer relative to the material and repeating the measuring and converting steps until the decibel level at the interface surface of the material is in the range of about 120 dB to about 190 dB, or more preferably in the range of about 160 dB to about 185 dB. In the formula $(\lambda)(n/4)$, "$\lambda$" is the wavelength of the ultrasonic oscillations and "n" is in the range of plus or minus 0.5 of an odd integer so that the acoustic oscillations at the interface surface of the material are within about a 90-degree range centered at about maximum amplitude. Preferably, "n" is an odd integer so that the acoustic oscillations at the interface surface of the material are at about maximum amplitude.

The specific techniques and structures employed by the invention to improve over the drawbacks of the prior devices and accomplish the advantages described herein will become apparent from the following detailed description of the example embodiments of the invention and the appended drawings and claims.

DETAILED DESCRIPTION

Figure 1:
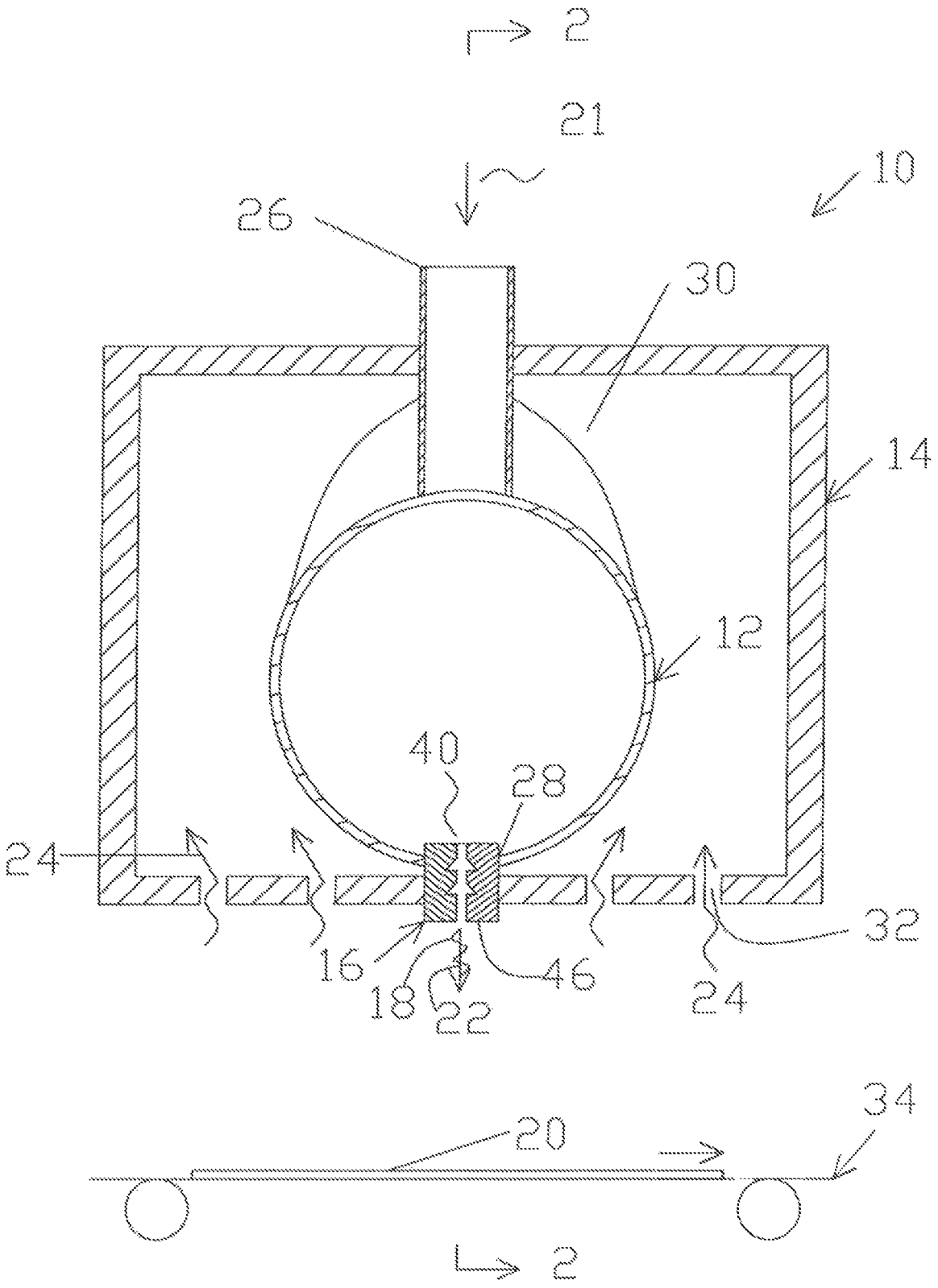
FIG. 1 is a longitudinal cross-sectional view of a drying apparatus according to a first example embodiment of the present invention, showing an air delivery enclosure, an ultrasonic transducer, and an air return enclosure in use drying a material.
Figure 2:
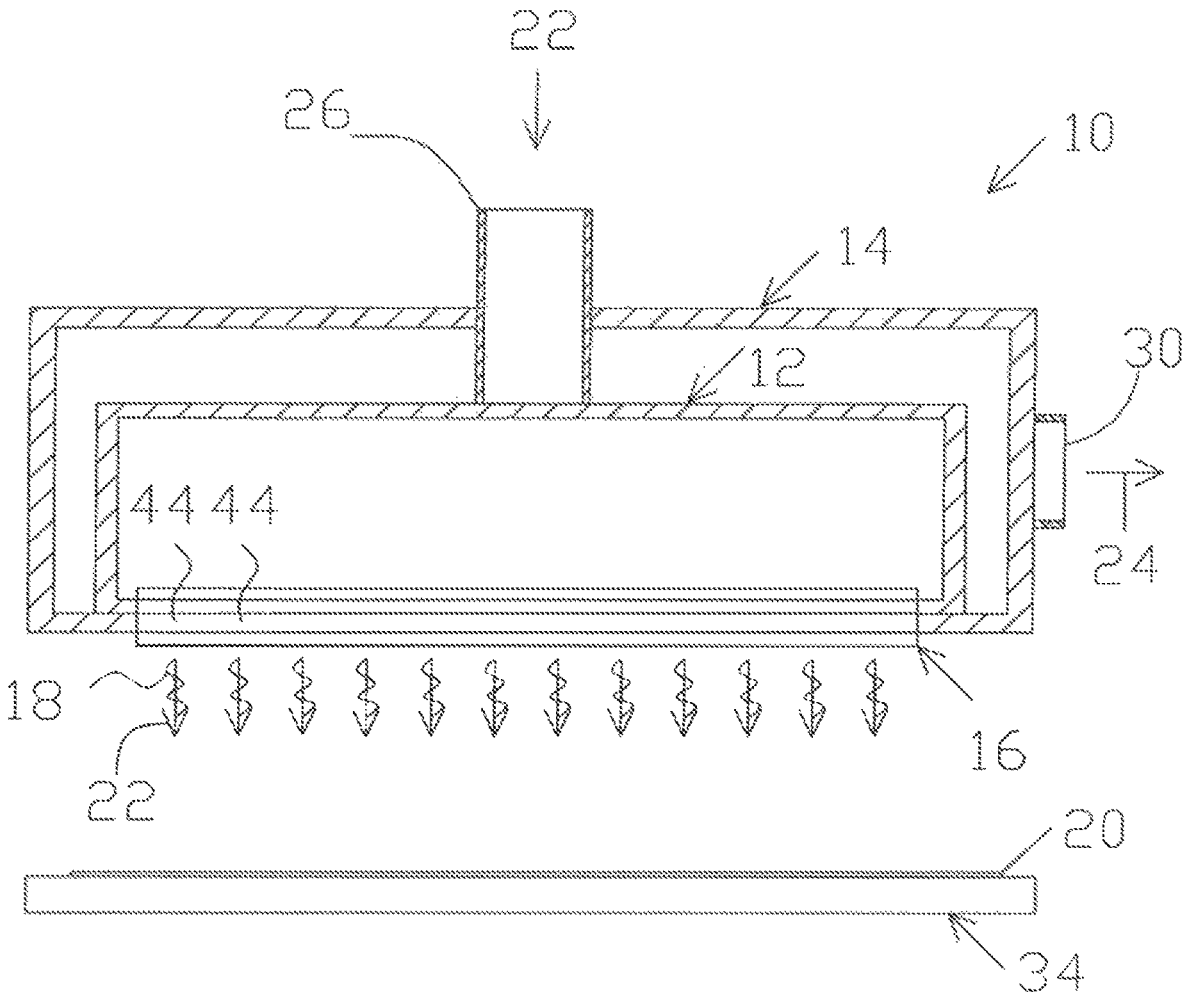
FIG. 2 is a cross-sectional view of the drying apparatus taken at line 2-2 of FIG. 1.

The present invention provides drying systems and methods that include the use of ultrasound to more effectively break down the boundary layer and thereby increase the heat and/or mass transfer rate. Example embodiments of the invention are described herein in general configurations for illustration purposes. The invention also provides specific configurations for use in specific applications such as but not limited to printing, residential and commercial cooking appliances, food processing equipment, textiles, carpets, converting industries, fabric dyeing, and so on. In particular, the invention can be configured for flexographic and gravure printing of wallpaper, gift-wrap paper, corrugated containers, folding cartons, paper sacks, plastic bags, milk and beverage cartons, candy and food wrappers, disposable cups, labels, adhesive tapes, envelopes, newspapers, magazines, greeting cards, and advertising pieces. The invention can be adapted for these and many other batch and continuous heating and drying processes.

Referring now to the drawing figures, FIGS. 1-5 show a drying apparatus 10 according to a first example embodiment of the present invention. The drying apparatus 10 includes an air-delivery enclosure 12, an air-return enclosure 14, and at least one ultrasonic transducer 16. The ultrasonic transducer 16 delivers acoustic oscillations 18 (i.e., pulsating acoustic pressure waves) coupled with heated or ambient air 22 onto the boundary layer of a material 20 to be dried while the delivery enclosure 12 delivers a heated airflow 22 onto the material, and the return enclosure 14 draws moist air 24 away from the material. The air-delivery enclosure 12 has an air inlet 26 and at least one air outlet 28, and the air-return enclosure 14 has at least one air inlet 30 and an air outlet 32. In typical commercial embodiments, the delivery and return enclosures 12 and 18 are made of metal (e.g., sheet metal), though other materials can be used.

The material 20 to be dried can be any of a wide range of materials, depending on the application. For example, in printing applications the material to be dried is ink on paper, cardboard, plastic, fabric, etc., and for food processing equipment the material is food. Thus, the material 20 can be any substance or object for which heating and drying is desired.

In the depicted embodiment, the material 20 is conveyed beneath the apparatus 10 by a conventional conveyor system 34. In alternative embodiments, the material 20 is conveyed into operational engagement with the apparatus 10 by another device and/or the apparatus is moved relative to the material.

Figure 5:
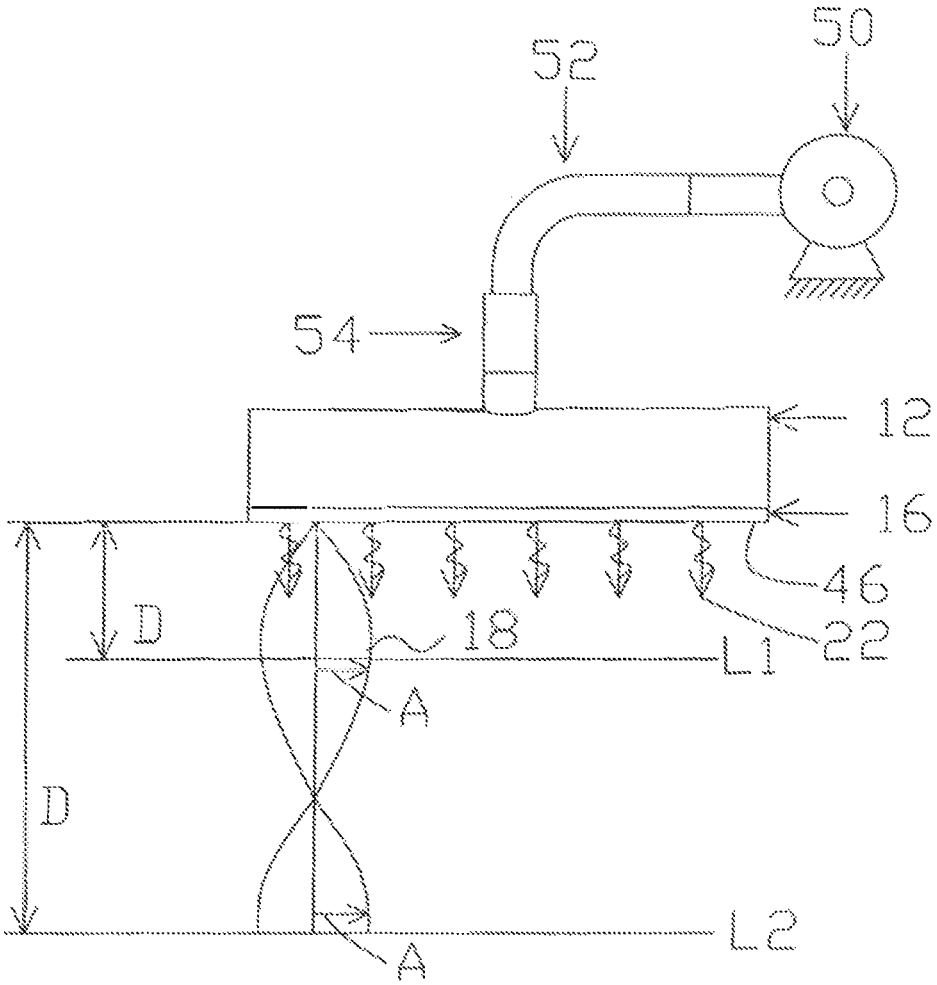
FIG. 5 is a side view of the air delivery enclosure of FIG. 1, showing the distance between the outlet from ultrasonically charged air that comes out of the enclosure with ultrasonic transducer and the material being dried.

A steady-state forced airflow 21 is delivered to the delivery enclosure 12 under positive pressure by an air-moving device 50 that is connected to the air inlet 26 by an air conduit 52 (see FIG. 5). And the return airflow 24 is drawn away from material 20 under the influence of an air-moving device that is connected to the return enclosure air outlet 30 by an air conduit. As such, the delivery enclosure 12 is a positive-pressure plenum and the return enclosure 14 is a negative-pressure plenum. The air-moving devices 50 may be provided by conventional fans, blowers, or compressors, and the air conduits 52 may be provided by conventional metal piping. In alternative embodiments, the air-moving devices are integrally provided as parts of the apparatus 10, for example, with the delivery air-mover positioned inside the delivery enclosure 12 and the return air-mover positioned inside the return enclosure 14.

In typical commercial embodiments, the steady-state inlet airflow 21 is pre-heated by a heat source 54 that is positioned near the apparatus 10 and connected to the delivery enclosure inlet 26 (see FIG. 5). In some alternative embodiments, a heat source is included in the delivery enclosure 12, in addition to or instead of the pre-heater. And in alternative embodiments for applications in which no or relatively little heat is required for the needed drying, the airflow 21 is not heated before being delivered onto the material 20. In such embodiments, the frictional forces from operating the pneumatic ultrasonic transducers 16 can generate temperatures of for example about 150° F., which in some applications is sufficient that a pre-heater is not needed. And in some embodiments without heating, the apparatus 10 may be provided without the return enclosure 14.

The delivery enclosure 12, the return enclosure 14, and the ultrasonic transducer 16 of the depicted embodiment are arranged for enhanced thermal insulation of the heated delivery airflow 21. In particular, the delivery enclosure 12 is positioned inside the return enclosure 14 so that the warm moist return air 24 in the return enclosure helps reduce heat loss by the heated air 21 in the delivery enclosure. The ultrasonic transducer 16 is positioned in the delivery enclosure air outlet 28 and extends through the return enclosure 14. In alternative embodiments in which the heater is positioned within the delivery enclosure, only the portion of the delivery enclosure carrying heated air is positioned within the return enclosure. In other alternative embodiments, the delivery enclosure and the return enclosure are positioned in a side-by-side arrangement with the delivery enclosure positioned ahead of the return enclosure relative to the moving material. And in yet other alternative embodiments, the apparatus includes a plurality of the delivery enclosures, return enclosures, and ultrasonic transducers arranged concentrically, side-by-side, or otherwise.

The ultrasonic transducer 16 of the depicted embodiment is an elongated pneumatic ultrasonic transducer, the air outlet 28 of the delivery enclosure 14 is slot-shaped, and the transducer is positioned in the air outlet so that all of the steady-state airflow 21 is forced through the transducer. In this way, the heated airflow 22 and the acoustic oscillations 18 are delivered together onto the material 20. In alternate embodiments, the size and shape of the ultrasonic transducer 16 and the delivery enclosure air outlet 28 are selected so that some of the heated airflow 21 is not routed through the ultrasonic transducer but instead is routed around it and through the same or another air outlet. In other alternative embodiments, the apparatus 10 includes a plurality of the pneumatic ultrasonic transducers 16 (elongated or not) and the delivery enclosure 14 includes a plurality of the air outlets 28 (slot-shaped or not) for the transducers.

Figure 3:
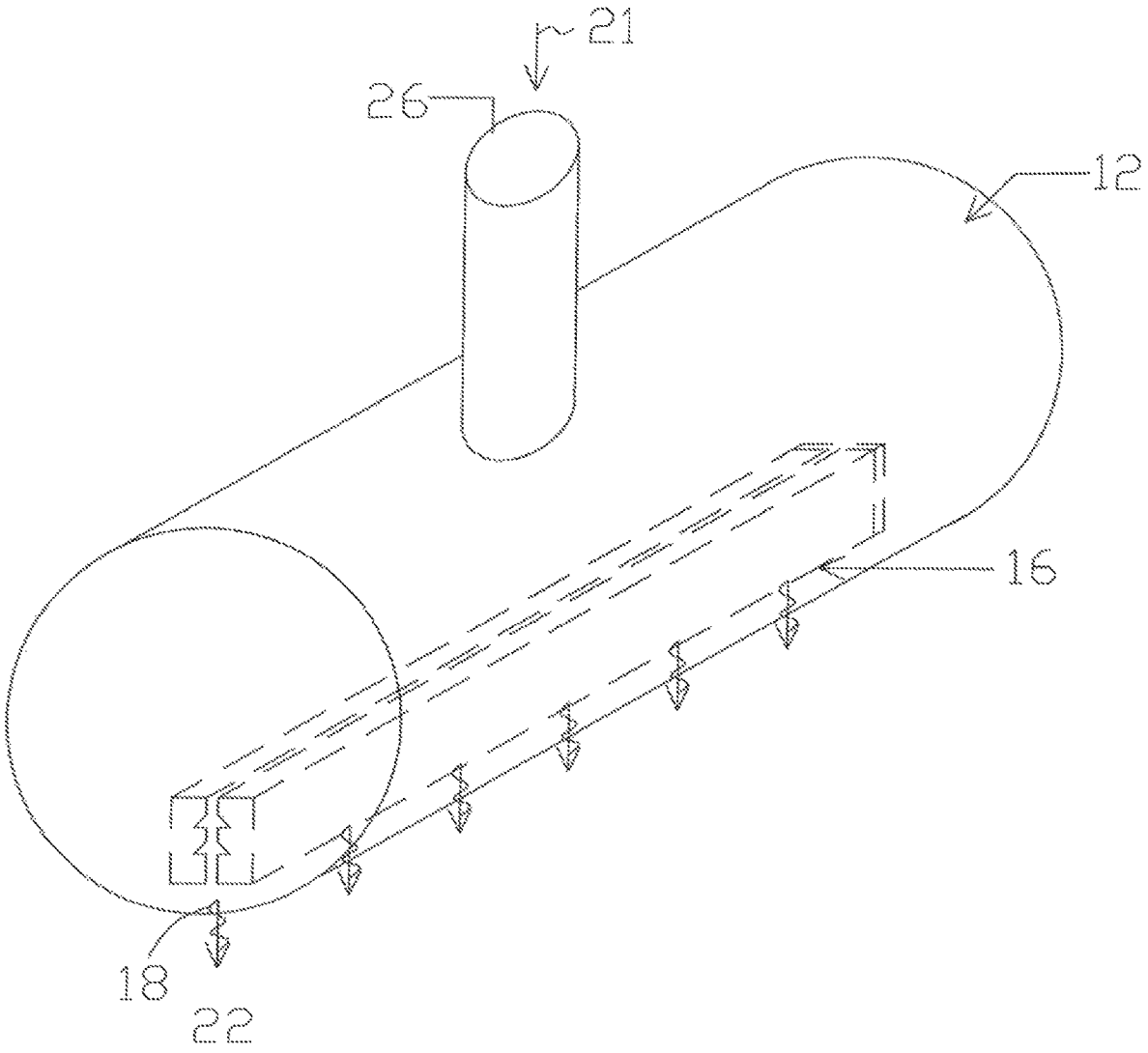
FIG. 3 is a perspective view of the air delivery enclosure of FIG. 1.
Figure 4A:
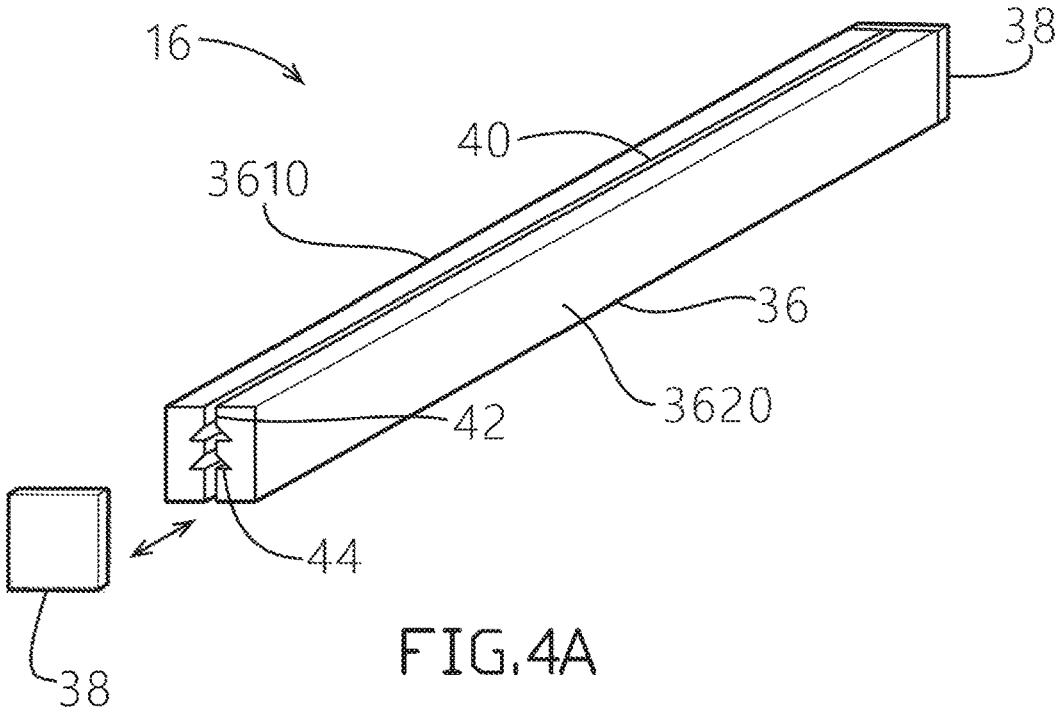
FIG. 4A is a partially exploded perspective view of the ultrasonic transducer of FIG. 1.
Figure 4B:
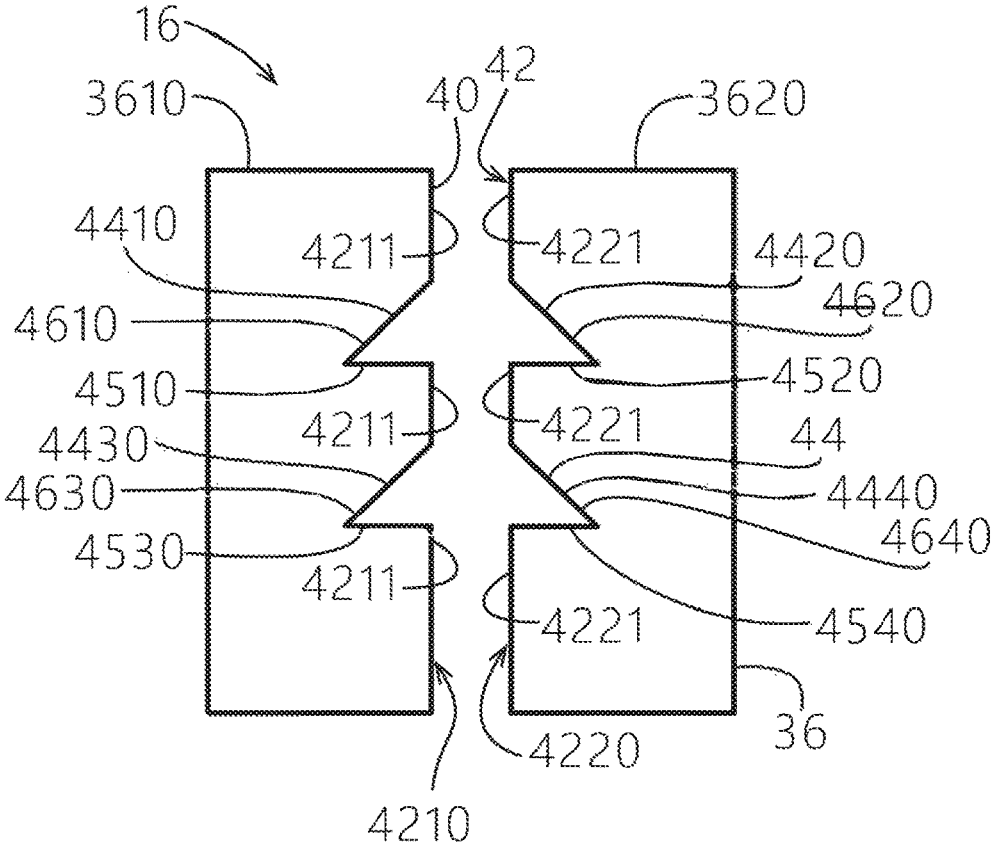
FIG. 4B is an end view of a first side wall and a second side wall of the ultrasonic transducer of FIG. 4A.

The ultrasonic transducer 16 depicted in FIGS. 3, 4A, and 4B includes two walls 36 and two end caps 38 that hold the walls 36 in place spaced apart from each other to form an air passage 40. The walls 36 can comprise a first wall 3610 and a second wall 3620. The first wall 3610 and the second wall 3620 can define an inner surface 42 comprising a first inner surface 4210 and a second inner surface 4220 and can define grooves 44. More specifically, the first wall 3610 can define the first inner surface 4210 and the second wall 3620 can define the second inner surface 4220. The first wall 3610 can define a first groove 4410 and a third groove 4430. Likewise, the second wall 3620 can define a second groove 4420 and a fourth groove 4440. Each of the grooves 4410,4420,4430, 4440 can extend the entire length of the respective wall 3610,3620, with the grooves 4410, 4430 of the first wall 3610 oppositely facing the grooves 4420,4440 of the second wall 3620. Each of the grooves 4410,4420,4430,4440 can respectively comprise a flat portion 4510,4520,4530,4540 and an angled portion 4610,4620,4630,4640. Moreover, the first inner surface 4210 can comprise an innermost portion 4211, and the second inner surface 4220 can comprise an innermost portion 4221. Each of the respective innermost portions 4211,4221 can be closest to a centerline of the air passage 40 of the ultrasonic transducer 16 as shown. Each of the flat portions 4510,4520,4530,4540 can be angled at 90 degrees with respect to—or orthogonal to—the respective innermost portion 4211,4221. Moreover, each of the grooves 4410,4420,4430,4440 can have a triangular cross-section. When the steady-state airflow 21 is forced through the air passage 40, the grooves 4410,4420,4430,4440 induce the acoustic oscillations 18 in the airflow 22 that exits the transducer 16. The depicted transducer 16 is designed to be operable to cost-efficiently produce certain desired decibel levels, as described below.

In alternative embodiments, the ultrasonic transducer 16 has more or fewer grooves, deeper or shallower grooves, different shaped grooves, a greater spacing between the grooves on the same wall, and/or a greater spacing between the walls. In other alternative embodiments, the ultrasonic transducer 16 has a U-shaped air passage that induces the acoustic oscillations. And in still other alternative embodiments, the ultrasonic transducer 16 is provided by another design of pneumatic transducer and/or by an electric-operated ultrasonic transducer.

The ultrasonic transducer 16 is operable to produce fixed frequency ultrasonic acoustic oscillations in the sound pressure range of about 120 dB to about 190 dB at the interface surface of the material 20 being treated. Preferably, the ultrasonic transducer 16 is designed for producing acoustic oscillations in the sound pressure range of about 130 dB to about 185 dB at the interface surface of the material 20 being treated, more preferably about 160 dB to about 185 dB, and most preferably about 170 dB to about 180 dB. These are the decibel levels at the interface surface of the material 20, not necessarily the output decibel level range of the ultrasonic transducer 16. In typical commercial embodiments, the ultrasonic transducer 16 is selected to generate up to about 170 to about 190 dBs, though higher or lower dB transducers could be used. Ultrasonic transducers that are operable to produce these decibel levels are not known to be commercially available and are not known to be used in commercially available heating and drying equipment.

Sound (ultrasound is part of it) dissipates with the second power to the distance, so the closer the ultrasonic transducer is positioned to the material, the lower in the dB range the dB level generated by the transducer can be. Many applications, by the nature of the process, require a transducer-to-material distance of from about 10 mm to about 100 mm. The longer the distance, the higher the dB level that must be generated by the ultrasonic transducer in order to obtain the needed dB level at the interface surface of the material. In addition, dB levels above the high end of the dB range could be used in some applications, but generally the larger transducers that would be needed are not as cost-effective and the sound level would be so high that humans could not safely or at least comfortably be present in the work area.

As shown in FIG. 5, the ultrasonic transducer 16 is positioned with its outlet 46 (where the ultrasound is emitted from) spaced from the interface surface of the material 20 to be dried by a distance D. The distance D is about $(\lambda)(n/4)$, where "$\lambda$" is the wavelength of the ultrasonic oscillations 18 and "n" is preferably an odd integer (1, 3, 5, 7, etc.). In this way, when the ultrasonic oscillations 18 reach the interface surface of the material 20, they are at about maximum amplitude A, which maximizes the disruption of the boundary layer and results in increased water/solvent evaporation rates. For relatively lower frequency oscillations, the distance D is preferably such that "n" is either 1 or 3, and most preferably such that "n" is 1, so that the distance D is minimized. For relatively higher frequency oscillations, "n" can be a larger odd integer. In alternative embodiments that produce workable results, the distance D is such that "n" is in the range of plus (+) or minus (−) 0.5 of an odd integer (0.5 to 1.5, 2.5 to 3.5, 4.5 to 5.5, 6.5 to 7.5, etc.). In other words, the oscillations are in the ranges of 45 to 135 degrees, 225 to 315 degrees, etc. In other alternative embodiments that produce workable results, the distance D is such that "n" is in the range of plus (+) or minus (−) 0.25 of an odd integer (i.e., 0.75 to 1.25, 2.75 to 3.25, 4.75 to 5.25, 6.75 to 7.25, etc.). In other words, the oscillations are in the ranges of 67.5 to 157.5 degrees, 247.5 to 337.5 degrees, etc. In this way, when the ultrasonic oscillations 18 reach the interface surface of the material 20, even though they are not at maximum amplitude A, they are still close enough to it (and within the workable and/or preferred decibel ranges) for acceptable boundary layer disruption.

In order for the ultrasonic transducer 16 to be spaced from the material 20 in this way, the apparatus 10 can be provided with a register surface fixing the distance D. For example, the register surface can be provided by a flat sheet and the material 20 can be conveyed across it on a conveyor belt driven by drive rollers before and after the sheet. Or the register surface can be provided by one or more rollers that support the material directly, by a conveyor belt supporting the material 20, or by another surface know to those skilled in the art. In any event, the register surface is spaced the distance D from the ultrasonic transducer 16 (or positioned slightly more than the distance D from the ultrasonic transducer to account for the thickness of the material 20 and the conveyor belt). Embodiments without a register surface are typically used when the material is web-based, otherwise self-supporting, or tensioned by conventional tensioning mechanisms.

In addition, the apparatus can be provided with an adjustment mechanism for adjusting the distance between the ultrasonic transducer 16 and the material 20. The adjustment mechanism may be provided by conventional devices such rack and pinion gearing, screw gearing or the like. The adjustment mechanism may be designed to move the air-delivery enclosure 12, air-return enclosure 14, and ultrasonic transducer 16 assembly closer to the material, to move the material closer to the ultrasonic transducer, or both.

In order to consistently produce the precise decibel levels at the interface surface of the material 20, a method of manufacturing and/or installing the apparatus 10 is provided. The method includes calibrating the apparatus 10 for the desired decibel levels. First, the distance D is calculated based on the frequency of the selected ultrasonic transducer 16. For example, an ultrasonic transducer 16 with an operating frequency of 33,000 Hz has a wavelength of about 0.33 inches at a fixed temperature, so acceptable distances D include (0.33)(3/4) equals 0.25 inches and (0.33)(5/4) equals 0.41 inches, based on the formula D equals (λ)(n/4). Similarly, an ultrasonic transducer 16 with an operating frequency of 33 kHz has a wavelength of about 0.41 inches, so acceptable distances D include (0.41)(3/4) equals 0.31 inches and (0.41)(5/4) equals 0.51 inches.

Then the ultrasonic transducer 16 is positioned at the calculated distance D from the material 20 (or from the conveyor belt that will carry the material, or from the register surface). Next, a sound input device (e.g., a microphone) is placed at the material 20 (or at the conveyor belt that will carry the material, or at the register surface, or at the distance D from the ultrasonic transducer 16). The sound input device is connected to a signal conditioner. The sound input device and the signal conditioner are used to measure the air pressure wave (i.e., the acoustic oscillations 18) in psig and convert that to decibels (dB). For example, at a temperature of 120° F. and a flow rate of 35 ft/sec, a sound wave measured at 5 psig converts to 185 dB. Suitable microphones and signal conditioners are commercially available from Endevco Corporation (San Juan Capistrano, Calif.) and from Bruel & Kjer (Switzerland).

Once this baseline decibel level has been determined, the apparatus 10 can be adjusted for maximum effectiveness. For example, the adjustment mechanism can be adjusted to alter the preset distance D to see if the decibel level increases or decreases at the altered distance. If it decreases, then the preset distance D was accurate to produce the maximum amplitude A, and this distance is used. But if it increases, then the altered distance D is used as the new baseline and the distance is adjusted again. This fine-tuning process is repeated until the maximum amplitude A within the design ranged is found.

In addition, because the depicted embodiment includes a pneumatic-type ultrasonic transducer 16, it is operable to produce the desired decibel levels by adjusting the flow-rate of the steady-state inlet airflow 21. So if the baseline decibel level is not in the desired range, then the inlet airflow 21 rate can be adjusted (e.g., by increasing the speed of the fan or blower) until the decibel level is in the desired range. Exactly the same procedure can be applied to electrically powered ultrasonic transducers. Similar adjustments can be made with a signal amplifier, when electrically based ultrasonic transducers are used.

Table 1 shows test data demonstrating the resulting increased effectiveness of the apparatus 10. The test data in Table 1 was generated using the apparatus 10 of FIGS. 1-5, and the data are the averages from sixty tests.

TABLE 1

| | Δ Pressure | | | Water Removal (grams) | | Factor of |
|---|---|---|---|---|---|---|
| Distance (inches) | (in. H20 column) | Temp. (° F.) | Speed (ft/min) | at 169 dB | at 175 dB | Improvement |
| 0.6 | 4.3 | 160 | 30 | 8.16 | 13.88 | 1.7 |
| 0.6 | 4.3 | 160 | 60 | 3.99 | 11.58 | 2.9 |
| 0.6 | 4.3 | 160 | 90 | 3.19 | 7.02 | 2.2 |

The "Distance" is the distance D between the ultrasonic transducer 16 and the material 20, in inches. The "Δ Pressure" is the differential pressure drop in the air supply line in both experiments, measured in inches of water column, representing that the same amount of air was delivered through the acoustic dryer and non-acoustic dryer at the same temperature. The differential pressure of air corresponds to the amount of air supplied from the regenerative blower, it was the same in both cases, so the only difference between two series of experiments was ultrasound. Measurement of differential pressure in the air supply line is the most accurate and inexpensive method of measuring the quantity of air delivered by the blower. The "Temp." is the temperature of the inlet steady-state air 21. The "Speed" is the speed of the conveyer (i.e., the speed of the material 20 passing under the ultrasonic transducer 16). The "Water Removal" is the amount of water removed by the apparatus 10, first when operated at an airflow rate so that the ultrasonic transducer 16 produces acoustic oscillations 18 at the interface surface of the material 20 of 169 dB and then of 175 dB. As can be seen, a noted improvement is provided by operating the apparatus 10 so that it produces 175 dB acoustic oscillations at the interface surface of the material 20 instead of 169 dB.

Figure 6:
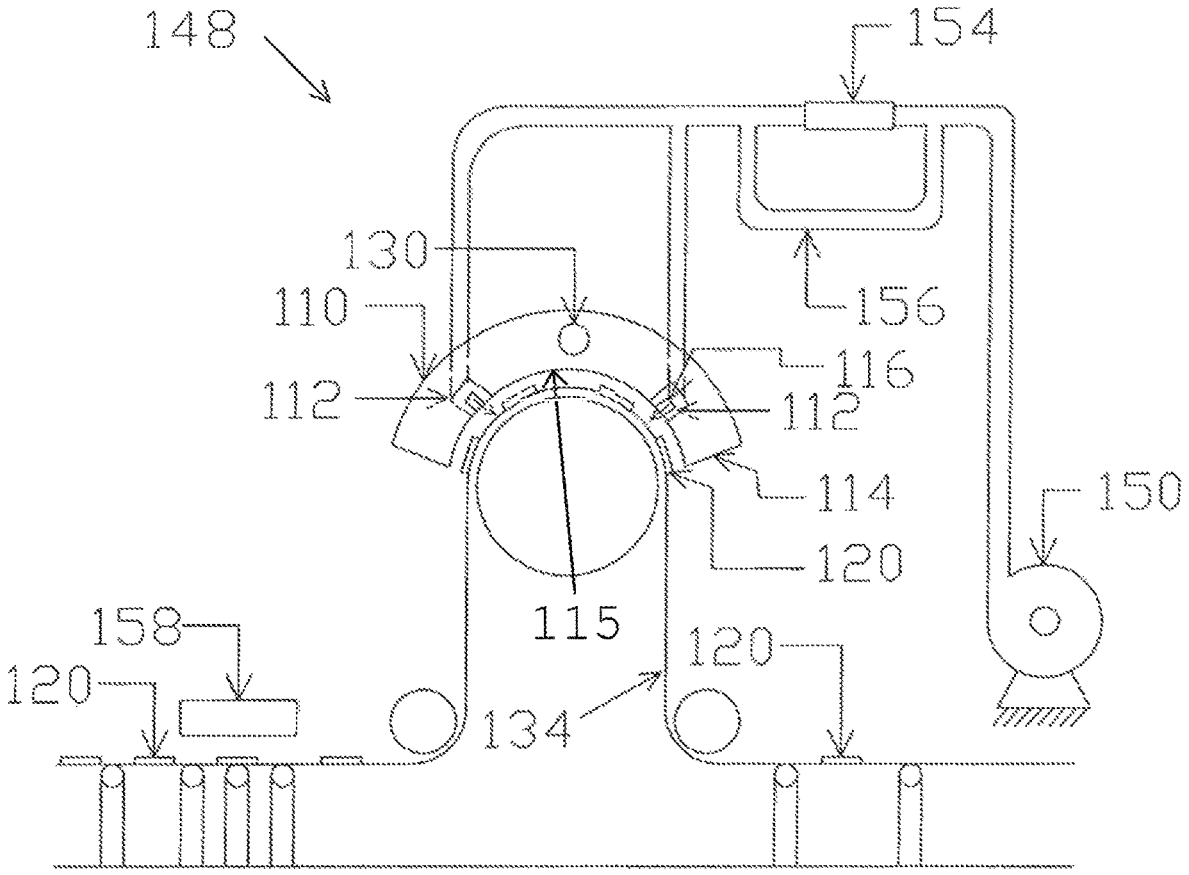
FIG. 6 is a side view of a converting or printing system including a drying apparatus according to a second example embodiment of the invention.

FIG. 6 shows an apparatus 110 according to a second example embodiment of the invention, with the apparatus included in a printing system 148 that additionally includes other components known to those skilled in the art. In this embodiment, the apparatus 110 includes two delivery enclosures 112, one return enclosure 114 with one exhaust outlet 130, and two ultrasonic transducers 116. In addition to the apparatus 110, the printing system 148 includes an air-moving device 150 (e.g., a fan, blower, or compressor), air conduits 152, and a heater 154, which cooperate to deliver heated steady-state air to the apparatus. A heater bypass conduit 156 is provided for print jobs in which no preheating is needed. The system 148 also includes a printing block 158 for applying ink (or paint, dye, etc.) to articles (e.g., labels, packaging) thereby forming the material 120 to be dried, and a conveyor system 134 for delivering the material to the apparatus 110 to dry the ink on the articles. In typical commercial embodiments, the conveyor system 134 is designed to operate at speeds of about 150-1,000 ft/min.

Figure 7:
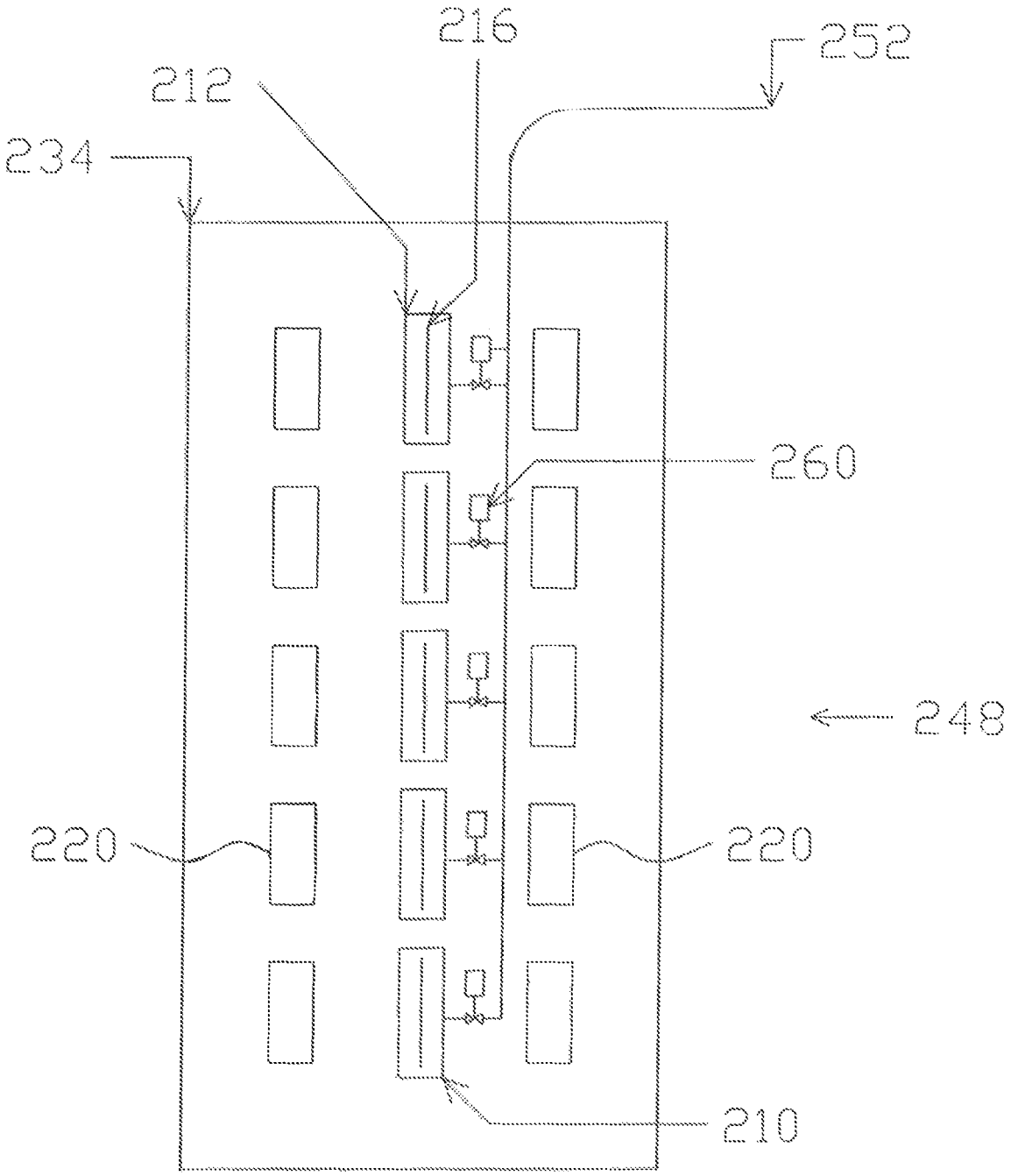
FIG. 7 is a plan view of a system including a converting or printing apparatus according to a third example embodiment of the invention.

FIG. 7 shows an array of apparatus 210 according to a third example embodiment of the invention, with the apparatus included in a printing system 248 that additionally includes other components known to the skilled in the art. In this embodiment, the apparatus 210 includes five delivery enclosures 212 each having at least one ultrasonic transducer 216. In addition to the apparatus 210, the printing system 248 includes an air-moving device (not shown), air conduits 252 connecting the apparatus to the air-mover, and control valving 260. The printing system 148 also includes a conveyor system 234 for conveying the material 220 past the apparatus 210. The valving 260 can be controlled to operate all or only selected ones of the apparatus 210 for localizing the drying, depending on the particular job at hand. For example, in some print jobs only a portion of the material 220 is to be dried (e.g., when ink is not applied to the entire surface of a container or label), and in some print jobs the material may be of a smaller the typical size, so some of the valves 260 can be turned off to shut down the apparatus 210 not needed for the job.

Figure 8:
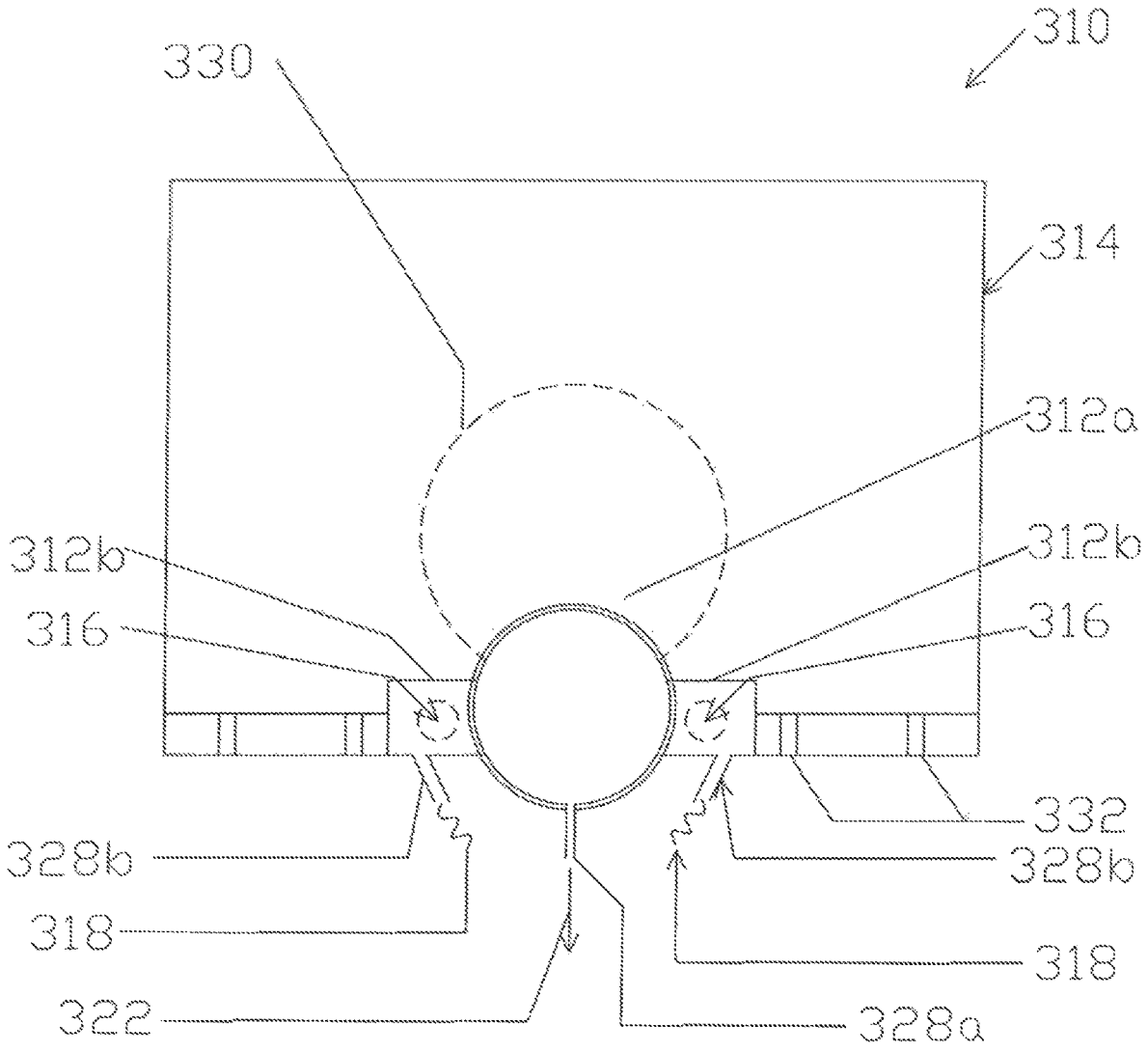
FIG. 8 is a longitudinal cross-sectional view of a drying apparatus according to a fourth example embodiment of the present invention, showing two acoustic delivery enclosures and an interposed dedicated standard or steady state air delivery enclosure.

FIG. 8 shows an apparatus 310 according to a fourth example embodiment of the invention. In this embodiment, the apparatus 310 is similar to that of the first embodiment, in that it includes a return enclosure 314 with a plurality of return air inlets 332 and an air outlet 330, and at least one delivery enclosure within the return enclosure. However, in this embodiment, the apparatus 310 includes three delivery enclosures, with one dedicated air delivery enclosure 312*a* having an air outlet 328*a* and with two acoustic delivery enclosures 312*b* each having at least one air outlet 328*a* and at least one ultrasonic transducer 316. The dedicated air delivery enclosure 312*a* delivers steady-state air 322 through the air outlet 328*a* and toward the material. And the acoustic delivery enclosures 312*b* deliver acoustic oscillations 318 through the air outlets 328*b* and toward the material. The acoustic delivery enclosures 312*b* are positioned immediately before and after (relative to the moving material) the dedicated air delivery enclosure 312*a*.

Figure 9:
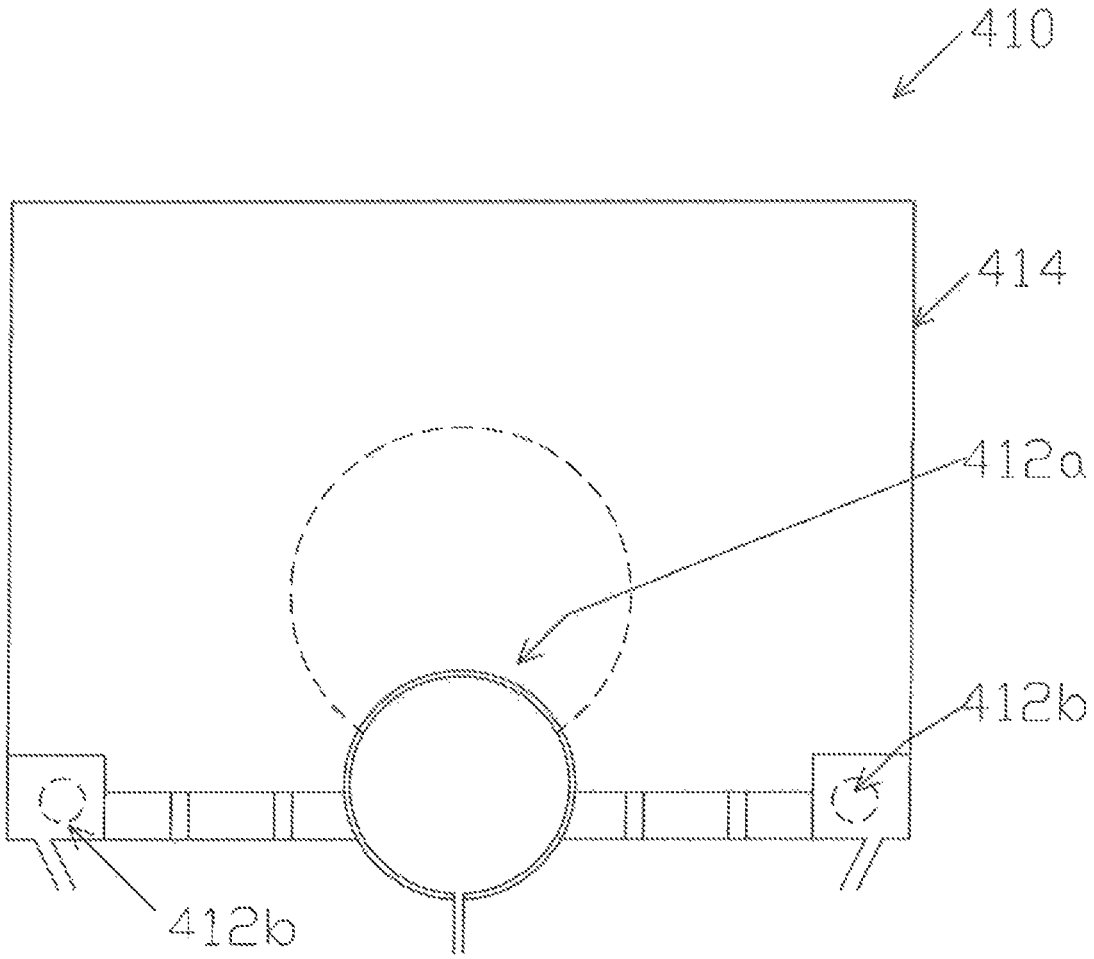
FIG. 9 is a longitudinal cross-sectional view of a drying apparatus according to a fifth example embodiment of the present invention, showing a dedicated air delivery enclosure and two acoustic delivery enclosures at the beginning and end of the drying zone.

FIG. 9 shows an apparatus 410 according to a fifth example embodiment of the invention. In this embodiment, the apparatus 410 is similar to that of the fourth embodiment, in that it includes a return enclosure 414, a dedicated air delivery enclosure 412*a*, and two acoustic delivery enclosures 412*b* each having at least one ultrasonic transducer 416. In this embodiment, however, the two acoustic delivery enclosures 412*b* are positioned on the front and rear ends (relative to the moving material) of the return enclosure 414, that is, at the very beginning and end of the drying zone.

Figure 10:
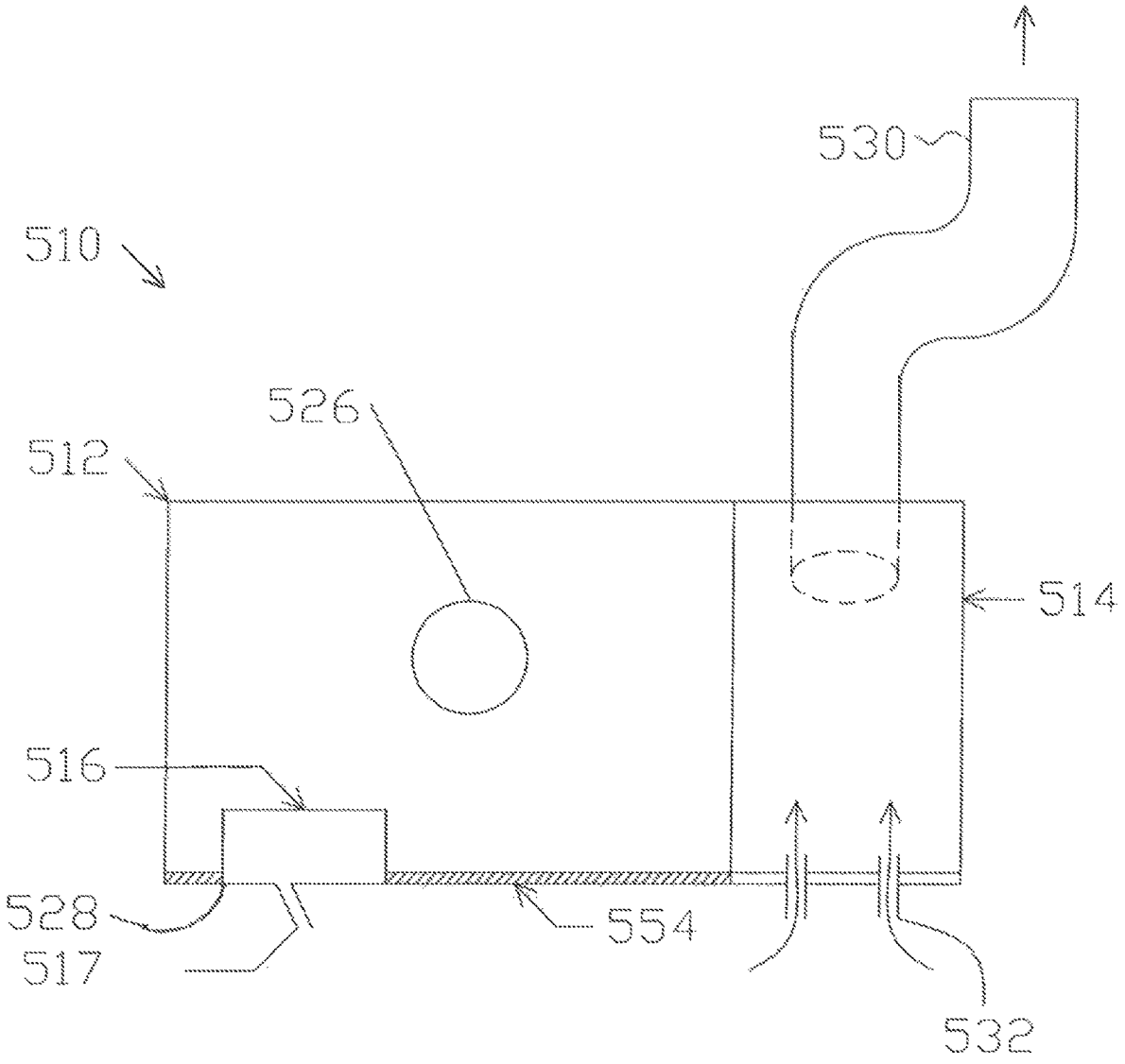
FIG. 10 is a longitudinal cross-sectional view of a drying apparatus according to a sixth example embodiment of the present invention, showing an air delivery enclosure and a return enclosure arranged in a side-by-side configuration.

FIG. 10 shows an apparatus 510 according to a sixth example embodiment of the invention. In this embodiment, the apparatus 510 is similar to that of the first embodiment, in that it includes a return enclosure 514 with at least one return air inlet 532 and an air outlet 530, a delivery enclosure 512 with at least one air outlet 528, and at least one ultrasonic transducer 516 positioned within the delivery enclosure air outlet. In this embodiment, however, the delivery enclosure 512 is not positioned within the return enclosure 514; instead, these enclosures are arranged in a side-by-side configuration. In addition, the ultrasonic transducer 516 includes a directional outlet conduit 517 extending from it for directing the acoustic oscillations more precisely.

Furthermore, an electric heater 554 is embedded in or mounted to the delivery enclosure 512 for applying heat directly to the material instead of (or in addition to) preheating the air to be delivered to the material. So the function of the air forced through the ultrasonic transducer 516 is only being a carrier for the ultrasound. The electric heater 554 can be mounted to the outside bottom surface of the delivery enclosure 512 or it can be mounted within the enclosure to the inside bottom surface (provided that the bottom wall of the enclosure has a sufficiently high thermal conductivity). The heater 554 can be of a conventional electric type or another type known to those skilled in the art.

Figure 11:
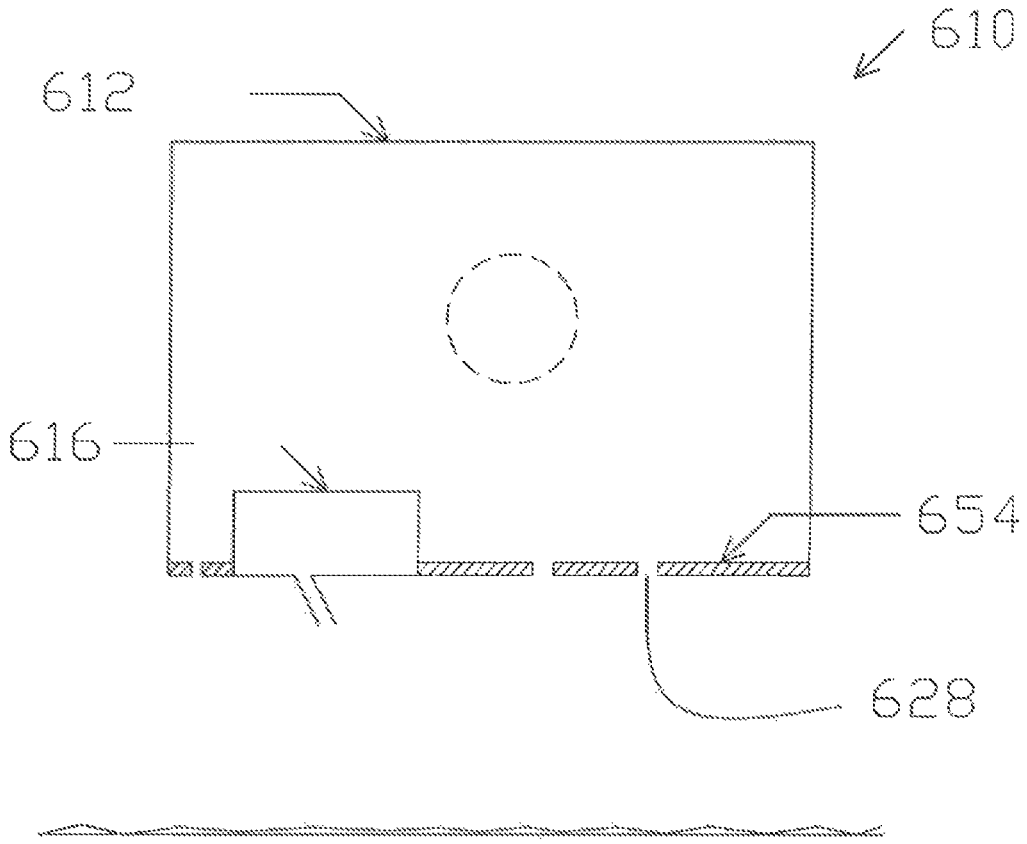
FIG. 11 is a longitudinal cross-sectional view of a drying apparatus according to a seventh example embodiment of the present invention, showing an air delivery enclosure and an ultrasonic transducer without a return enclosure.

FIG. 11 shows an apparatus 610 according to a seventh example embodiment of the invention. In this embodiment, the apparatus 610 is similar to that of the sixth embodiment, in that it includes a delivery enclosure 612 housing at least one ultrasonic transducer 616 and at least one heater 654. In this embodiment, however, the apparatus 610 does not include a return enclosure for removing moist air. This embodiment is suitable for applications in which there is less moisture to be removed from the material.

Figure 11A:
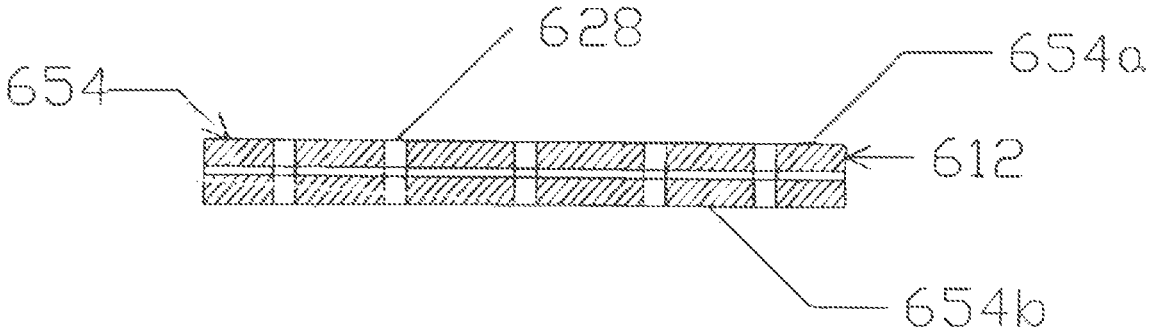
FIG. 11A is a detail view of a heater element of the apparatus of FIG. 11.

In addition, the heater 654 of this embodiment includes an inner heater element 654*a* and an outer heater element 654*b* mounted to the inside and outside surfaces of the bottom wall of the delivery enclosure 612 (see FIG. 11A). The inner and outer heater elements 654*a* and 654*b* can be provided by thermal conductive plates (e.g., of aluminum) with embedded resistance heaters. Also, the delivery enclosure 612 includes air outlets 628 for delivering steady-state air to the material separately from the acoustic oscillations delivered by the ultrasonic transducer 616. These air outlets 628 in the delivery enclosure 612 extend through both of the heater elements 654*a* and 654*b*. This embodiment of the heater provides bi-directional heating to the air inside the delivery enclosure 612 (convective heat) and directly to the material (radiant heat). In alternative embodiments, one of the heater elements can be provided in place of the bottom wall of the delivery enclosure, thereby doubling as a plenum wall and a heater.

Figure 12:
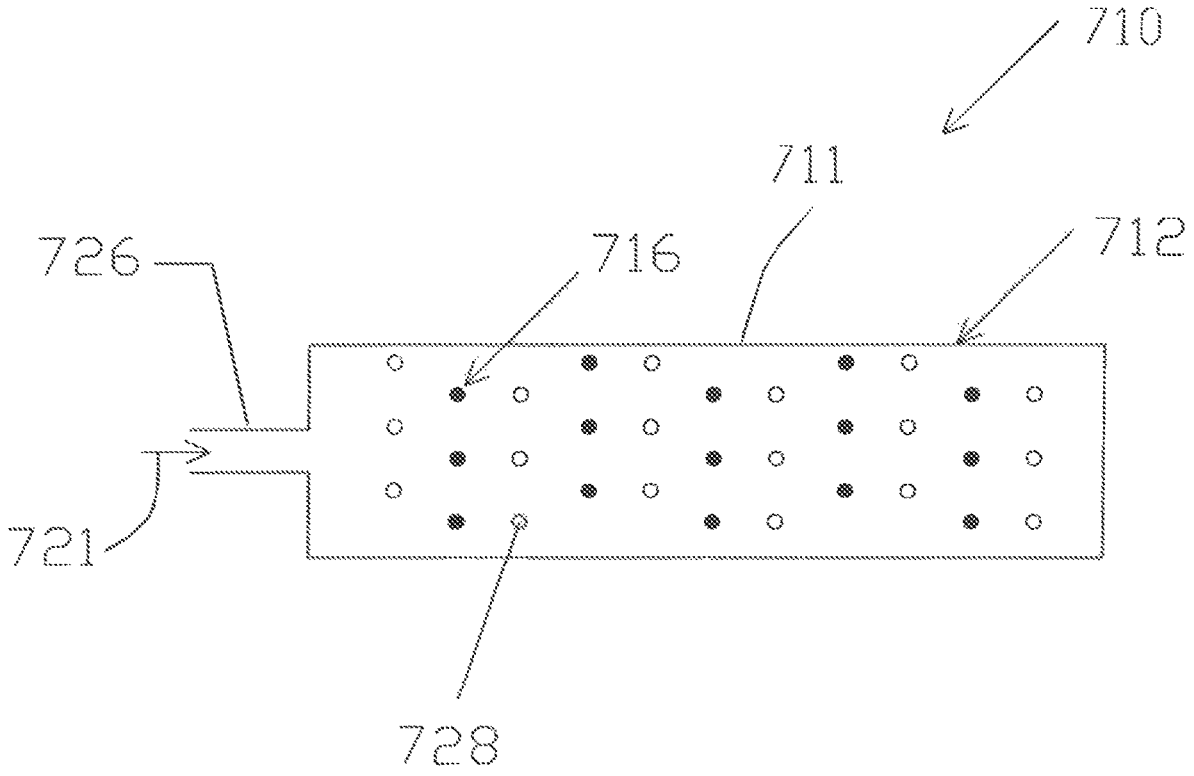
FIG. 12 is a front view of a drying apparatus according to an eighth example embodiment of the present invention, showing an air delivery enclosure and electric-operated ultrasonic transducers.
Figure 13:
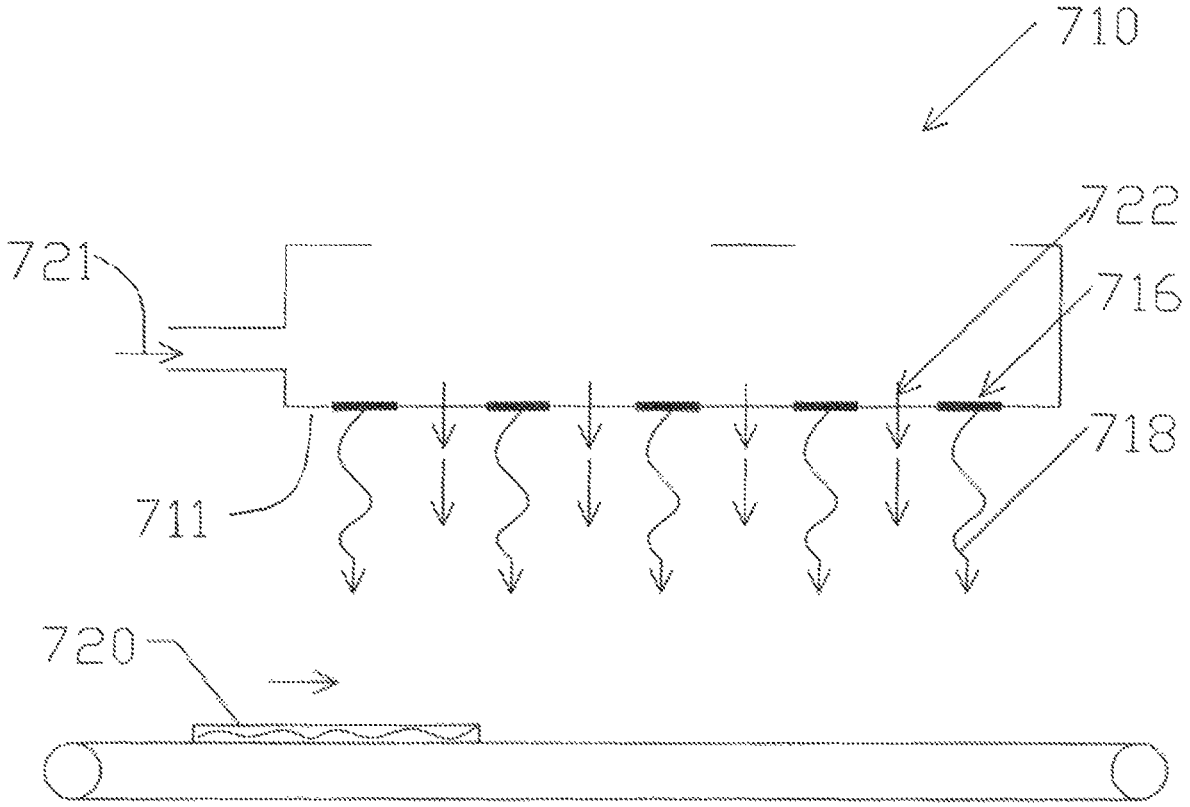
FIG. 13 is a side view of the drying apparatus of FIG. 12.

FIGS. 12 and 13 show an apparatus 710 according to an eighth example embodiment of the invention. In this embodiment, the apparatus 710 is similar to that of the seventh embodiment, in that it includes a delivery enclosure 712 with an air inlet 726 and a plurality of air outlets 728 defined in the delivery enclosure and with a plurality of ultrasonic transducers 716 mounted to the delivery enclosure. Steady-state air 721 is forced through the air inlet 726, into the enclosure 712, and out of the air outlets 728 toward the material 720, and the ultrasonic transducers 716 deliver acoustic oscillations 718 toward the material 720 onto the boundary layer.

In this embodiment, however, the ultrasonic transducers 716 are provided by electric-operated ultrasonic transducers. Such ultrasonic transducers are commercially available (with customizations for the desired decibel levels described herein) for example from Dukane Corporation (St. Charles, Ill.). The electric ultrasonic transducers 716 can be mounted to the exterior surface of the bottom wall 711 of the delivery enclosure 712 or positioned within openings in the bottom wall.

In addition, the ultrasonic transducers 716 and the air outlets 728 are arranged in an array on the delivery enclosure 712, preferably in a repeating alternating arrangement and also preferably in a staggered arrangement with a shift to avoid dead spots (e.g., with a 30-degree shift). The ultrasonic transducers 716 and the air outlets 728 may be circular, though they can be provided in other shapes such as rectangular, oval, or other regular or irregular shapes. In addition, the ultrasonic transducers 716 may have a diameter of about 2 inches, and the air outlets 728 may have a diameter of about 0.4 to 0.8 inches, though these can be provided in other larger or smaller sizes. Furthermore, the ultrasonic transducers 716 may be spaced apart at about 1 to 50 diameters, though larger or smaller spacings can be used. The number of ultrasonic transducers 716 and air outlets 728 are selected to provide the drying desired for a given application, and in typical commercial embodiments are provided in about equal numbers anywhere in the range of about 1 to about 100, depending on the physical properties of an individual transducer, that is, its physical size, the area of coverage, etc.

Figure 14:
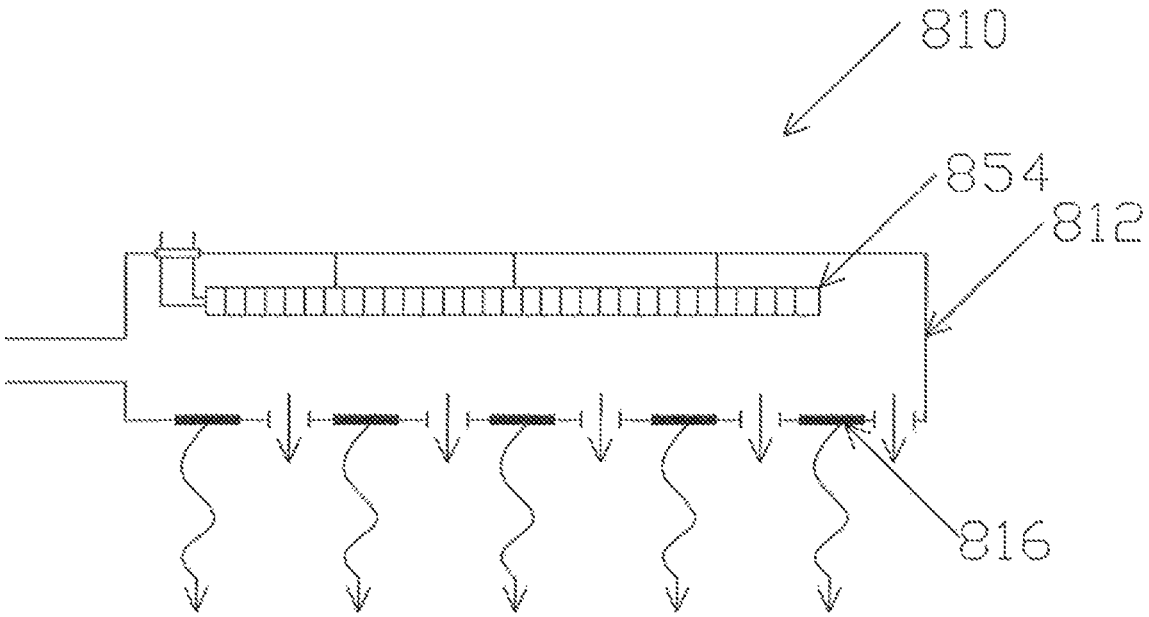
FIG. 14 is a side cross-sectional view of a drying apparatus according to a ninth example embodiment of the present invention, showing an air delivery enclosure with an electric-operated heater.

FIG. 14 shows an apparatus 810 according to a ninth example embodiment of the invention. In this embodiment, the apparatus 810 is similar to that of the eighth embodiment, in that it includes a delivery enclosure 812 with a plurality of air outlets 828 and with a plurality of ultrasonic transducers 816. In this embodiment, however, a heater 854 is mounted within the delivery enclosure 812 to heat the air before it is delivered to the material. The heater 854 in this embodiment can be of a similar type as that provided in the embodiments of FIGS. 10 and 11, or it can be of another known electrical or other type of heater.

Figure 15:
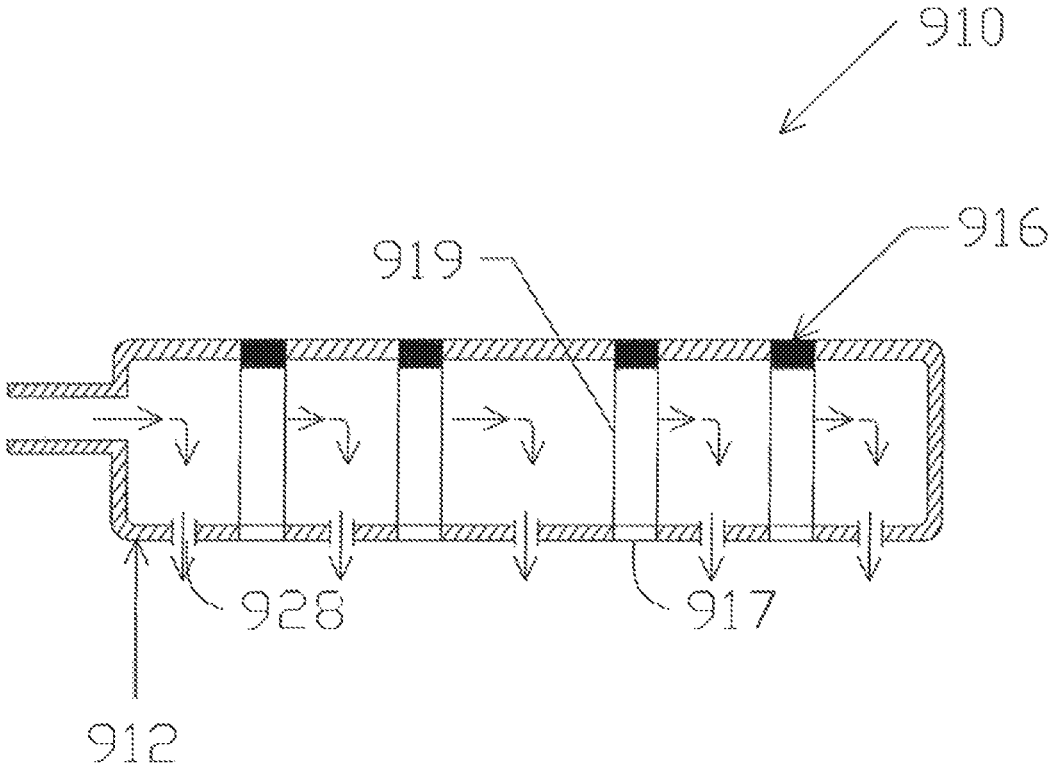
FIG. 15 is a side cross-sectional view of a drying apparatus according to a tenth example embodiment of the present invention, showing an air delivery enclosure with waveguides for the ultrasonic transducers.

FIG. 15 shows an apparatus 910 according to a tenth example embodiment of the invention. In this embodiment, the apparatus 910 is similar to that of the eighth embodiment, in that it includes a delivery enclosure 912 with a plurality of air outlets 928 and with a plurality of ultrasonic transducers 916. In this embodiment, however, the ultrasonic transducers 916 are mounted within waveguides 919 that are positioned within the delivery enclosure 912 for focusing/enhancing and directing the acoustic oscillations toward the material. The waveguides 919 are preferably provided by conduits that have outlets 917 through the front wall of the delivery enclosure 912 (closest to the material to be dried) and that extend all the way through (or at least a substantial portion of the way through) the delivery enclosure. And the transducers 916 are preferably positioned adjacent the back wall (opposite the material to be dried) of the delivery enclosure 912. The waveguide conduits 919 are preferably tubular with a cross-sectional shape (e.g., circular) that conforms to that of the ultrasonic transducers 916. The ultrasonic transducers 916 can be mounted to the inside back surface of the delivery enclosure 912 or they can be installed into openings in the delivery enclosure (such that they form that portion of the enclosure wall). This compact embodiment is particularly useful in applications in which there is little space for the apparatus.

Figure 16:
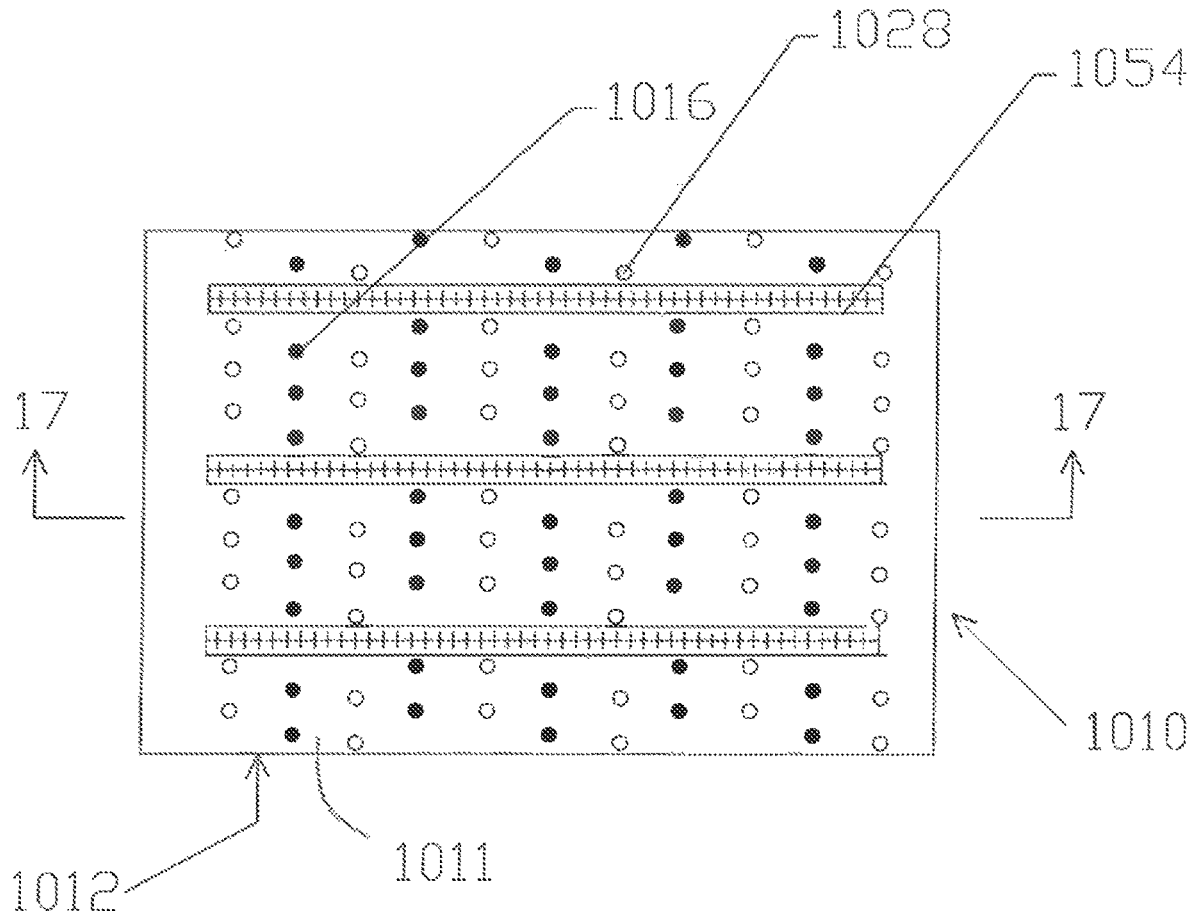
FIG. 16 is a front view of a drying apparatus according to an eleventh example embodiment of the present invention.
Figure 17:
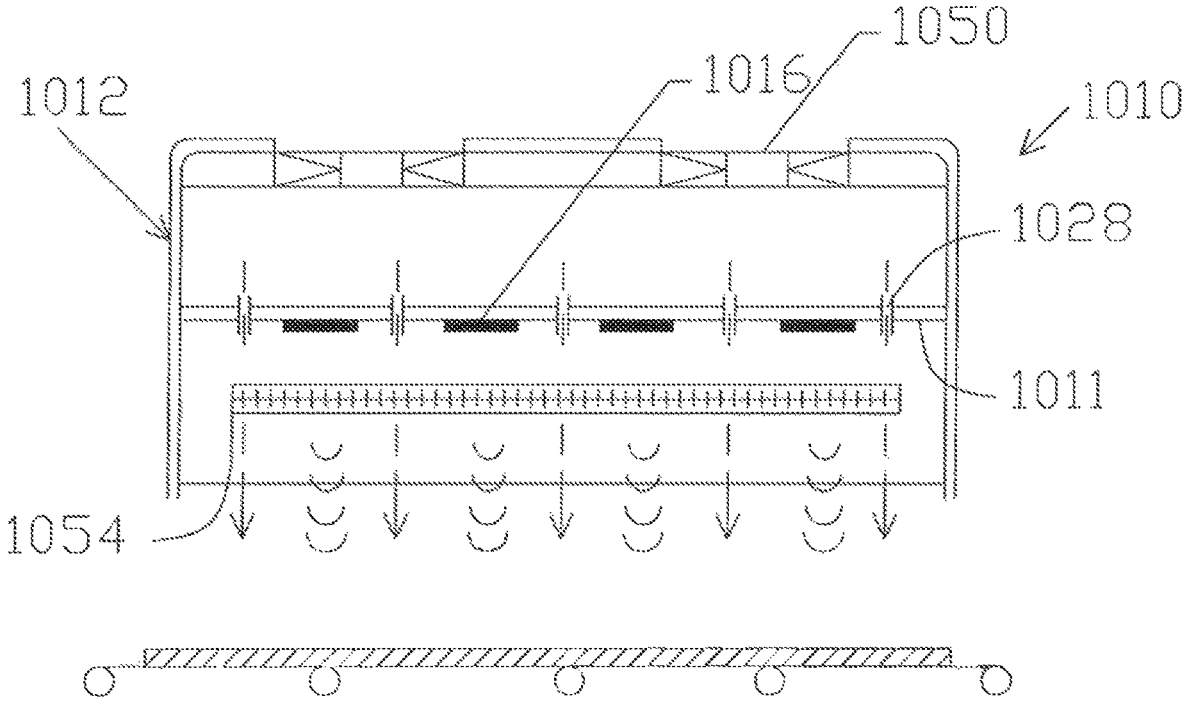
FIG. 17 is a cross-sectional view of the drying apparatus taken at line 17-17 of FIG. 16.

FIGS. 16 and 17 show an apparatus 1010 according to an eleventh example embodiment of the invention. In this embodiment, the apparatus 1010 is similar to that of the eighth embodiment, in that it includes a delivery enclosure 1012 with a bottom wall 1011 having plurality of air outlets 1028, and a plurality of ultrasonic transducers 1016 mounted to the enclosure. In this embodiment, however, the apparatus 1010 additionally includes at least one infrared-light-emitting heater 1054. The depicted embodiment, for example, includes three infrared heaters 1054. The infrared heater 1054 can be of a conventional type, for example, a nichrome wire or carbon-silica bar type. The infrared heater 1054 can be mounted in front of the delivery enclosure 1012 (between the delivery enclosure and the material to be dried, as depicted), within the delivery enclosure, or even behind it. In addition, the apparatus includes at least one air-mover 1050, for example, the two fans depicted, mounted to the rear of the delivery enclosure 1012. In addition to better convecting the heat from the infrared heaters 1054 toward the material, the air-mover 1050 helps cool the delivery enclosure 1012 (conventional infrared heaters generate relatively high temperatures). This embodiment may be particularly useful in applications in which infrared heating is desired but the top/rear wall of the delivery enclosure 1012 may not exceed a certain temperature (e.g., 175° F. drying of porous synthetic materials, such as filter fabrics or technical textiles).

Figure 18:
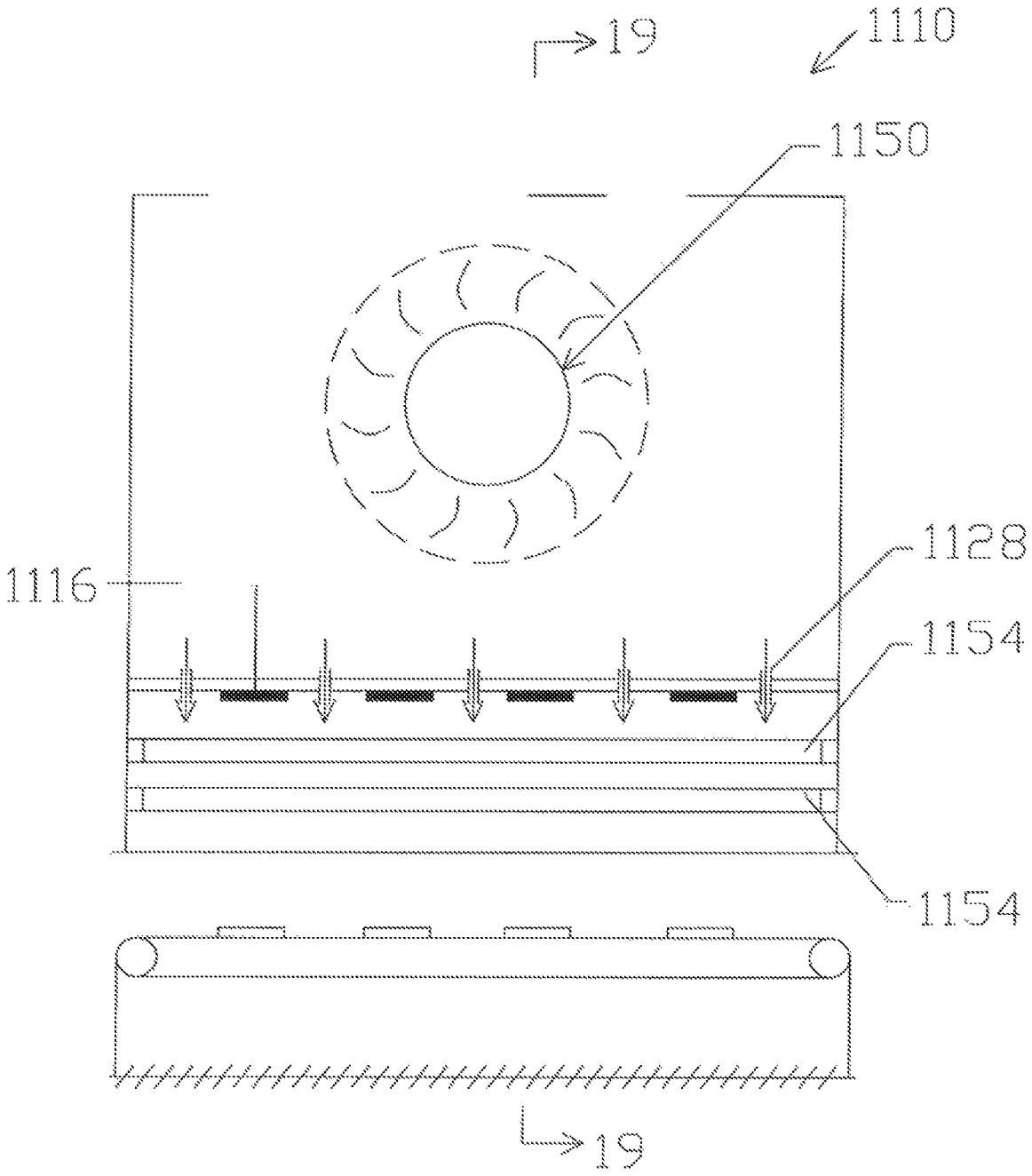
FIG. 18 is a side cross-sectional view of a drying apparatus according to a twelfth example embodiment of the present invention, including infrared heaters and an air-moving fan.
Figure 19:
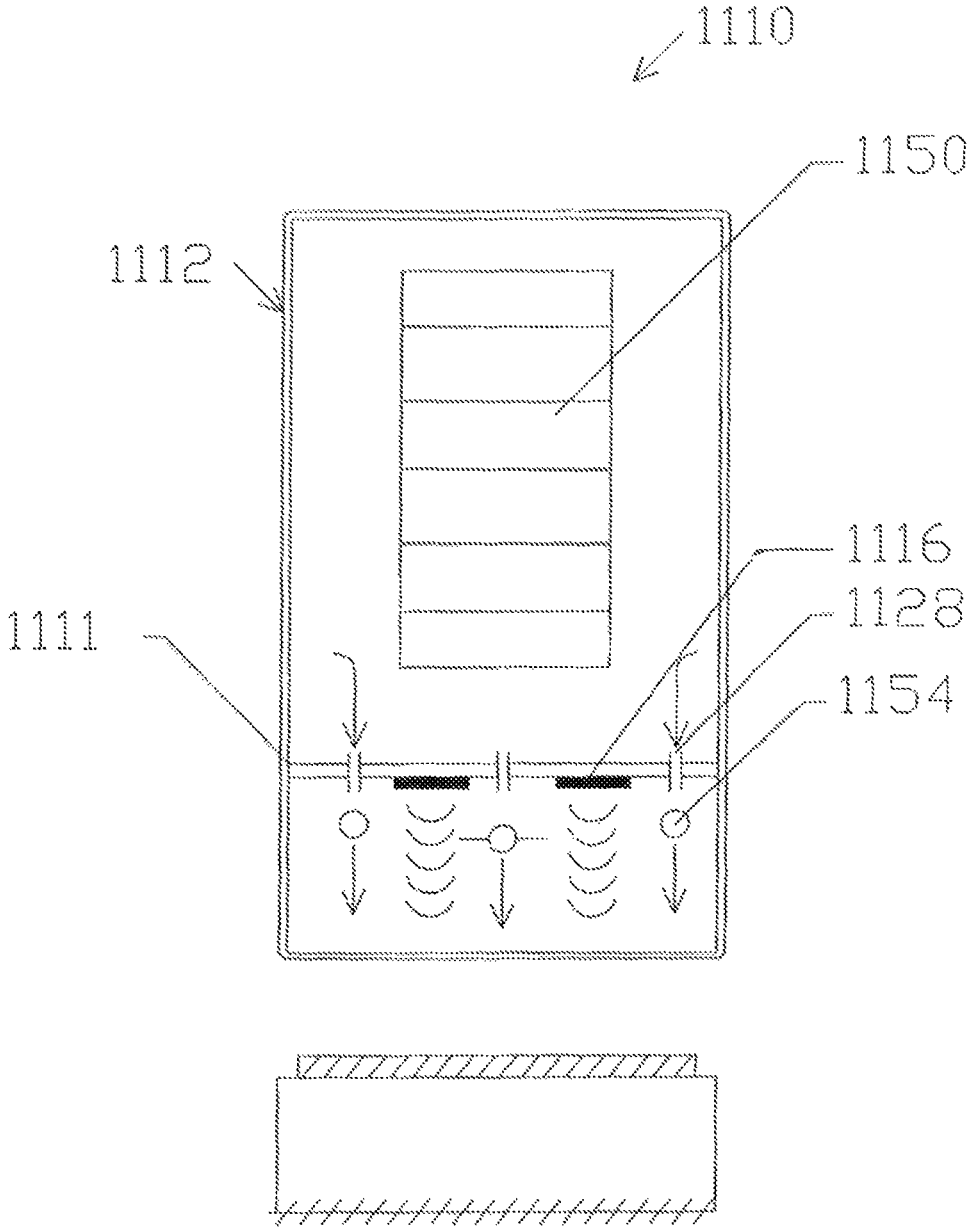
FIG. 19 is a cross-sectional view of the drying apparatus taken at line 19-19 of FIG. 18.

FIGS. 18 and 19 show an apparatus 1110 according to a twelfth example embodiment of the invention. In this embodiment, the apparatus 1110 is similar to that of the eleventh embodiment, in that it includes a delivery enclosure 1112 with a plurality of air outlets 1128 in its bottom wall 1111, a plurality of ultrasonic transducers 1116 mounted within it, at least one infrared heater 1154 mounted within it, and at least one air-mover 1150 mounted within it. This stand-alone embodiment may be particularly useful in the same applications as for the embodiment of FIGS. 16 and 17, except that this embodiment provides a more vertical configuration which saves footprint space for a more compact design. Such applications may include printing of mini-packaging, mailing labels, and other items for which short residence time and equipment compactness are desired.

Figure 20:
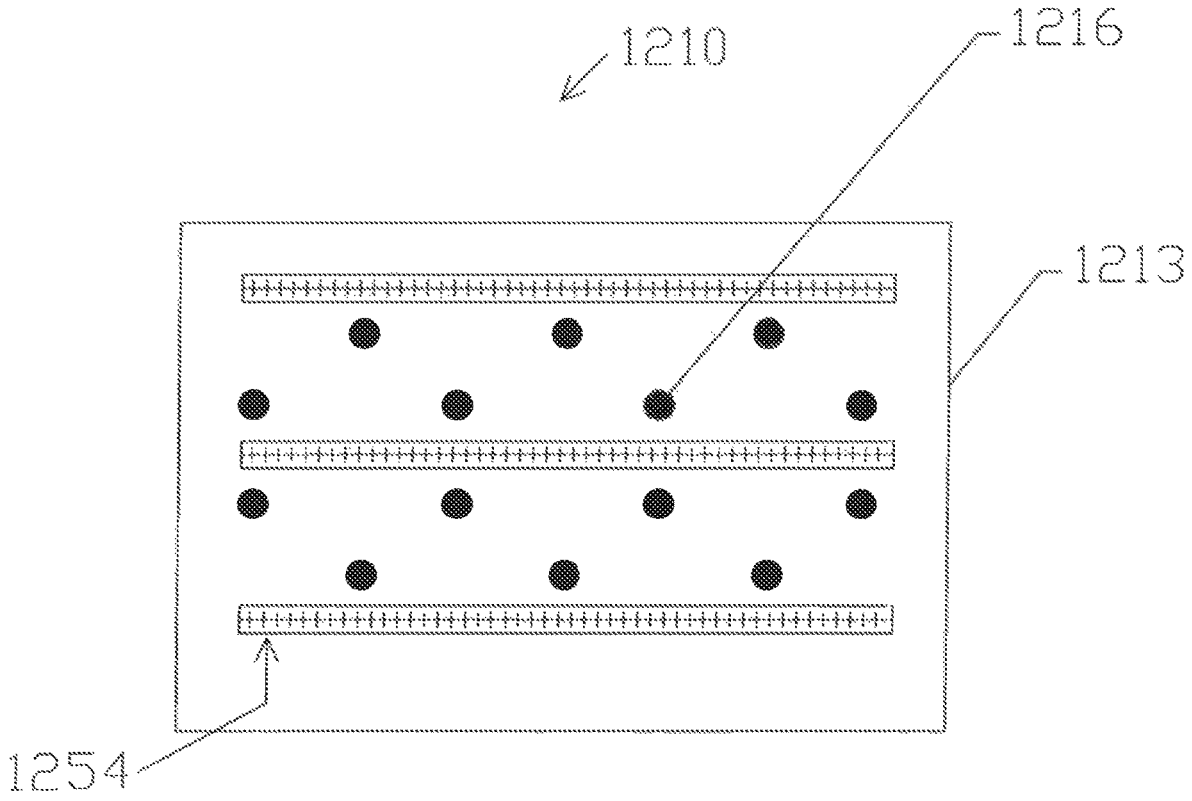
FIG. 20 is a front view of a drying apparatus according to a thirteenth example embodiment of the present invention, including infrared heaters without an air-moving fan.
Figure 21:
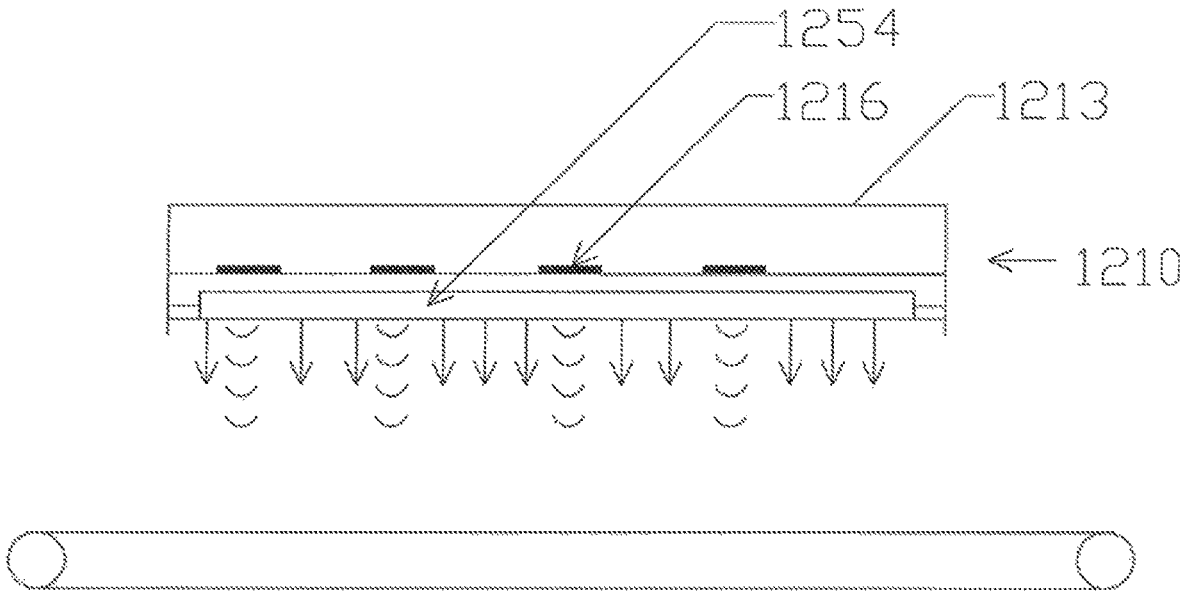
FIG. 21 is a side view of the drying apparatus of FIG. 20.

FIGS. 20 and 21 show an apparatus 1210 according to a thirteenth example embodiment of the invention. In this embodiment, the apparatus 1210 is similar to that of the eleventh embodiment, in that it includes a plurality of ultrasonic transducers 1216 for generating ultrasound and at least one infrared heater 1254 for generating heat. In this embodiment, however, steady-state air is not forced by an air mover through an enclosure with air outlets, and instead the infrared heater 1254 by itself generates the heated airflow. Because there is no delivery enclosure, the ultrasonic transducers 1216 are mounted to another element such as the depicted reflector panel 1213. This embodiment may be particularly useful in the applications for which relatively little heating is required and conserving space is a priority.

Figure 22:
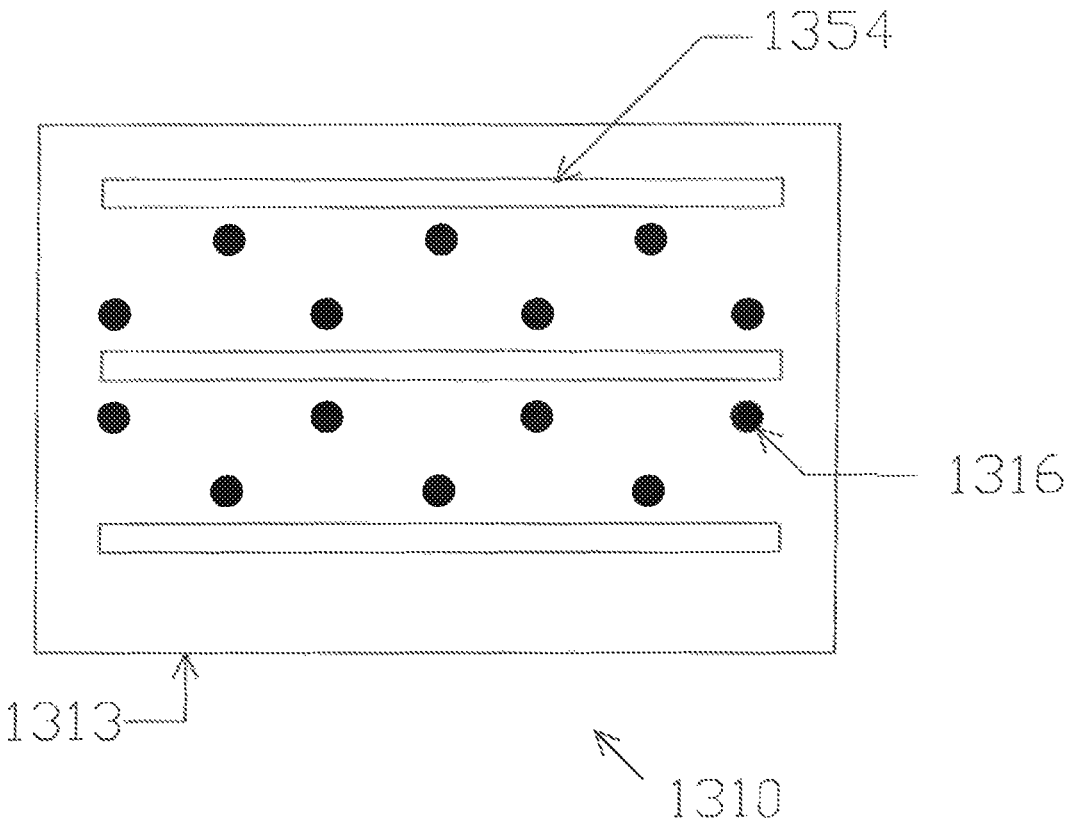
FIG. 22 is a front view of a drying apparatus according to a fourteenth example embodiment of the present invention, including ultraviolet (UV) heaters.

FIG. 22 shows an apparatus 1310 according to a fourteenth example embodiment of the invention. In this embodiment, the apparatus 1310 is similar to that of the thirteenth embodiment, in that it includes a plurality of ultrasonic transducers 1316 mounted on a panel 1313, with no steady-state air forced by an air mover through an enclosure with air outlets. Instead, the apparatus 1310 includes at least one ultraviolet (UV) emitter 1354 for generating the heated airflow. The depicted embodiment, for example, includes three UV emitters 1354. The UV heater 1354 can be of a conventional type known to those skilled in the art. This embodiment may be particularly useful in the applications for which relatively little heating is required, for example, drying specialty UV varnishes and UV water-based coatings.

Figure 23:
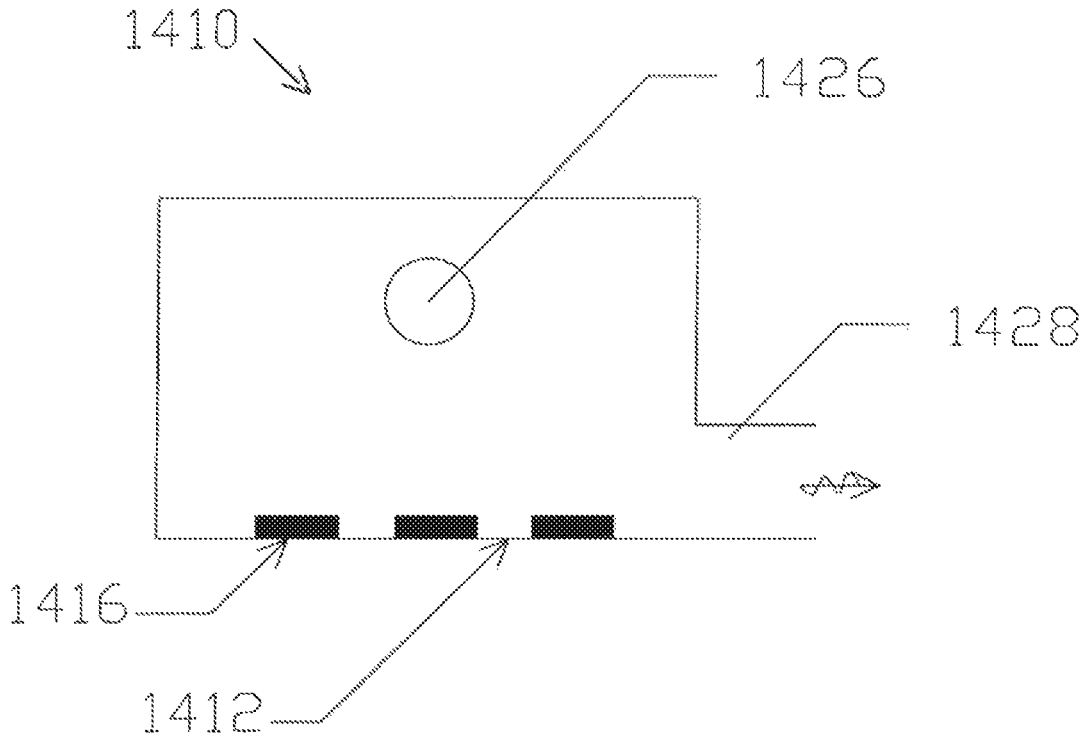
FIG. 23 is a side cross-sectional view of a drying apparatus according to a fifteenth example embodiment of the present invention.

FIG. 23 shows an apparatus 1410 according to a fifteenth example embodiment of the invention. In this embodiment, the apparatus 1410 is similar to that of the eighth embodiment, in that it includes a delivery enclosure 1412 with at least one air inlet 1426 and at least one air outlet 1428 for delivering forced air to the material, and at least one ultrasonic transducer 1416 for delivering acoustic oscillations to the material. In the particular embodiment shown, the apparatus 1410 includes an array of electric-operated ultrasonic transducers 1416. In this embodiment, however, the ultrasonic transducers 1416 are mounted within the delivery enclosure 1412 to set up a field of acoustic oscillations through which the forced air passes before reaching the material to be dried. In the depicted embodiment, for example, the ultrasonic transducers 1416 are mounted to an inner wall of the delivery enclosure 1412 and are not oriented to direct the acoustic oscillations toward the air outlet 1428.

Figure 24:
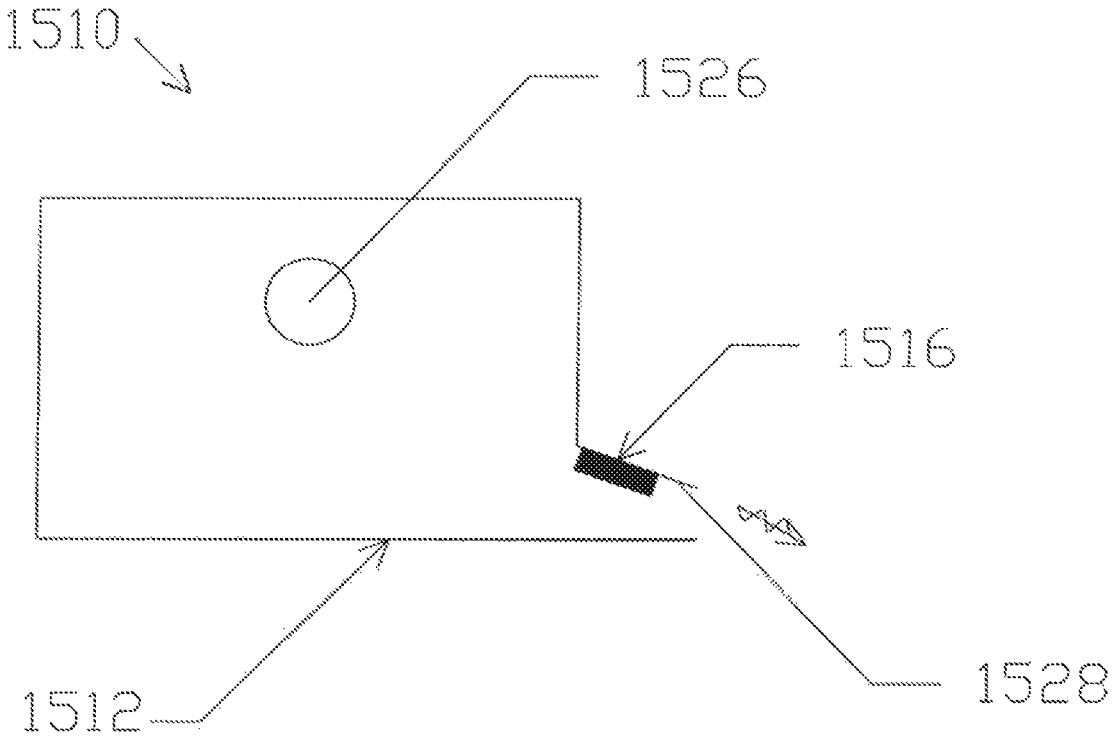
FIG. 24 is a side cross-sectional view of a drying apparatus according to a sixteenth example embodiment of the present invention.

FIG. 24 shows an apparatus 1510 according to a sixteenth example embodiment of the invention. In this embodiment, the apparatus 1510 is similar to that of the fifteenth embodiment, in that it includes a delivery enclosure 1512 with at least one air inlet 1526 and at least one air outlet 1528, and at least one electric-operated ultrasonic transducer 1516 mounted within the delivery enclosure for setting up a field of acoustic oscillations through which forced air passes before reaching the material to be dried. In this embodiment, however, the ultrasonic transducer 1516 is mounted immediately adjacent the air outlet 1528 and is not oriented to direct the acoustic oscillations toward the air outlet.

Figure 25:
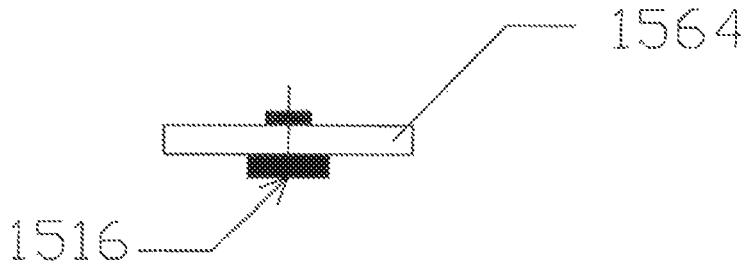
FIG. 25 is a side detail view of a wing mounted to an ultrasonic transducer of the drying apparatus of FIG. 24.

FIG. 25 shows a wing element 1564 that can be mounted to the electric-operated ultrasonic transducer 1516 of the embodiment of FIG. 25. The wing 1564 may be disk-shaped (e.g., for used with disk-shaped electric-operated ultrasonic transducers 1516), or it may be provided by a plurality of radially extending arms by another structure with at least one member extending away from the transducer. The wing 1564 may be made of a material such as steel, titanium, or another metal. With the wing 1564 mounted to the electric ultrasonic transducer 1516, when the transducer is operated it induces vibrations in the wing, which vibrations enhance the acoustic oscillations for more effective disruption of the boundary layer. Thus, the wings 1564 function as mechanical amplifiers, working in resonance with the electric ultrasonic transducers 1516 to increase the amplitude of the ultrasonic pressure wave. The wing 1564 can be included in any of the example embodiments, and alternative embodiments thereof, that include electric-operated ultrasonic transducers.

Having described numerous embodiments of the invention, it should be noted that the individual elements of the various embodiments described herein can be combined into other arrangements that form additional embodiments not expressly described herein. For example, such additional embodiments include modular versions of the various embodiments that can be combined in different arrangements depending on the particular application. As additional examples, the apparatus of FIGS. 1-5 can be provided with infrared or UV emitters, and the apparatus of FIGS. 12 and 13 can be provided with a return air enclosure. Such additional embodiments are within the scope of the present invention.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

That which is claimed is:

1. A drying apparatus comprising:

a delivery enclosure defining a bottom wall, the bottom wall defining a plurality of air outlets;

a plurality of ultrasonic transducers mounted to the delivery enclosure, the plurality of ultrasonic transducers and the plurality of air outlets being arranged in an array on the delivery enclosure, the plurality of ultrasonic transducers and the plurality of air outlets further being arranged in a repeating alternating arrangement, each of a portion of the plurality of ultrasonic transducers positioned adjacent to a portion of the plurality of air outlets;

an air mover mounted to the delivery enclosure; and an infrared heater configured to emit infrared light.

2. The apparatus of claim 1, wherein adjacent ultrasonic transducers of the plurality of ultrasonic transducers are spaced apart by a distance equal to between one and fifty diameters of one of the plurality of air outlets, inclusive.

3. The apparatus of claim 1, further comprising a plurality of infrared heaters.

4. The apparatus of claim 1, wherein the infrared heater is one of a nichrome wire or carbon-silica bar type.

5. The apparatus of claim 1, wherein the infrared heater is positioned between the bottom wall of the delivery enclosure and a material to be dried by the apparatus.

6. The apparatus of claim 1, wherein each of the plurality of air outlets defines a circular shape defining a diameter of between 0.4 and 0.8 inches, inclusive.

7. The apparatus of claim 1, wherein the air mover is a blower, a direction of flow of air entering the blower angled at 90 degrees with respect to a direction of flow of air exiting the blower.

8. A method of drying a material using the apparatus of claim 1, comprising:

blowing air from the air mover; and drying the material with each of infrared light emitted by the infrared heater and acoustic oscillations emitted by the ultrasonic transducer.

9. A method of drying a material using the apparatus of claim 1, further comprising:

maintaining a temperature of a surface of the delivery enclosure below a desired temperature.

10. A drying apparatus comprising:

a plurality of ultrasonic transducers, the plurality of ultrasonic transducers being mounted to a reflector panel; and an infrared heater positioned proximate to the plurality of ultrasonic transducers and configured to emit infrared light, the plurality of ultrasonic transducers positioned between the reflector panel and the infrared heater.

11. A method of drying a material using the apparatus of claim 10, comprising:

delivering acoustic oscillations to the material with each of the plurality of ultrasonic transducers; and generating heated airflow with the infrared heater without assistance of an air mover.

12. A drying apparatus comprising:

a delivery enclosure defining a plurality of air outlets;

an ultrasonic transducer mounted to the delivery enclosure; and a heater configured to produce radiant heat, the heater comprising an inner heater element and an outer heater element, each of the plurality of air outlets extending through each of the inner heater element and the outer heater element, each of the inner heater element and the outer heater element defining thermal conductive plates.

13. The apparatus of claim 12, wherein the inner heater element is mounted to an inside surface of a bottom wall of the delivery enclosure and the outer heater element is mounted to an outside surface of the bottom wall of the delivery enclosure.

14. The apparatus of claim 12, wherein one of the inner heater element and the outer heater element doubles as a plenum wall of the delivery enclosure.

15. A method of drying a material using the apparatus of claim 12, comprising:

heating the material by convection by:

heating air inside the delivery enclosure with the inner heater element; and delivery heated air from inside the delivery enclosure to the material through the plurality of air outlets; and heating the material by radiation with the outer heating element.

16. A method comprising:

drying a material using an apparatus comprising:

a delivery enclosure defining a bottom wall, the bottom wall defining a plurality of air outlets;

an ultrasonic transducer mounted to the delivery enclosure;

an air mover mounted to the delivery enclosure; and an infrared heater configured to emit infrared light; and maintaining a temperature of a surface of the delivery enclosure below a desired temperature.

17. The method of claim 16, wherein drying the material comprises:

blowing air from the air mover; and drying the material with each of infrared light emitted by the infrared heater and acoustic oscillations emitted by the ultrasonic transducer.

18. A drying apparatus comprising:

a delivery enclosure defining a plurality of air outlets;

an ultrasonic transducer mounted to the delivery enclosure; and a heater configured to produce radiant heat, the heater comprising an inner heater element and an outer heater element, each of the inner heater element and the outer heater element defining thermal conductive plates, the inner heater element being mounted to an inside surface of a bottom wall of the delivery enclosure and the outer heater element being mounted to an outside surface of the bottom wall of the delivery enclosure.

19. A drying apparatus comprising:

a delivery enclosure defining a plurality of air outlets;

an ultrasonic transducer mounted to the delivery enclosure; and a heater configured to produce radiant heat, the heater comprising an inner heater element and an outer heater element, each of the inner heater element and the outer heater element defining thermal conductive plates, one of the inner heater element and the outer heater element doubling as a plenum wall of the delivery enclosure.

20. A method of drying a material comprising:

obtaining the drying apparatus, the drying apparatus comprising:

a delivery enclosure defining a plurality of air outlets;

an ultrasonic transducer mounted to the delivery enclosure; and a heater configured to produce radiant heat, the heater comprising an inner heater element and an outer heater element, each of the inner heater element and the outer heater element defining thermal conductive plates;

heating the material by convection by:

heating air inside the delivery enclosure with the inner heater element; and delivery heated air from inside the delivery enclosure to the material through the plurality of air outlets; and heating the material by radiation with the outer heating element.

* * * * *